US006495948B1

(12) United States Patent
Garrett, III

(10) Patent No.: US 6,495,948 B1
(45) Date of Patent: Dec. 17, 2002

(54) SPARK PLUG

(75) Inventor: Norman H. Garrett, III, Atlanta, GA (US)

(73) Assignee: Pyrotek Enterprises, Inc., Ponte Vedra, FL (US)

( * ) Notice: Subject to any disclaimer, the term of this patent is extended or adjusted under 35 U.S.C. 154(b) by 0 days.

(21) Appl. No.: 09/260,974

(22) Filed: Mar. 2, 1999

Related U.S. Application Data

(60) Provisional application No. 60/076,669, filed on Mar. 2, 1998, provisional application No. 60/089,491, filed on Jun. 16, 1998, provisional application No. 60/089,499, filed on Jun. 16, 1998, and provisional application No. 60/114,439, filed on Dec. 31, 1998.

(51) Int. Cl.[7] ..... H01T 13/00; H01T 13/34; H01T 13/02

(52) U.S. Cl. ..... 313/141; 313/118; 313/142; 123/169 R; 123/169 EL

(58) Field of Search ..... 313/118, 123, 313/125, 126, 128, 133, 135, 136, 138, 139, 140, 141, 142, 143; 123/169 EL, 169 E

(56) References Cited

U.S. PATENT DOCUMENTS

| | | | | |
|---|---|---|---|---|
| 771,683 | A | 10/1904 | Svenson | 313/125 |
| 919,123 | A | 4/1909 | Brown | |
| 956,778 | A | 5/1910 | Palmer | |
| 971,908 | A | 10/1910 | Low | 313/140 |
| 995,989 | A | 6/1911 | Shaefer et al. | |
| 1,067,791 | A | 7/1913 | Duffy | |
| 1,077,325 | A | 11/1913 | Witter | |
| 1,087,897 | A | 2/1914 | Talbert | |
| 1,090,815 | A | 3/1914 | Harter | 313/123 |
| 1,116,238 | A | 3/1914 | Butler et al. | |
| 1,114,219 | A | 10/1914 | Young | |
| 1,120,384 | A | 12/1914 | Hoag et al. | 313/140 |
| 1,131,115 | A | 3/1915 | Carpentier | |
| 1,156,797 | A | 10/1915 | Meaker | |
| 1,172,893 | A | 2/1916 | Lippincott | |

(List continued on next page.)

FOREIGN PATENT DOCUMENTS

| | | |
|---|---|---|
| DE | 39 35 165 A1 | 4/1991 |
| DE | 94 03 943.7 | 6/1994 |

OTHER PUBLICATIONS

Patent Abstracts of Japan, vol. 097, No. 008, Aug. 29, 1997 JP 09 092434A (Nakano Tamotsu), Apr. 4, 1997.

*Primary Examiner*—Nimeshkumar D. Patel
*Assistant Examiner*—Mariceli Santiago
(74) *Attorney, Agent, or Firm*—Kilpatrick Stockton LLP

(57) ABSTRACT

The present invention relates to improved spark plugs for igniting a fuel charge in an internal combustion engine, and is particularly concerned with an improved spark plug construction which improves combustion pressure and fuel mileage and diminishes exhaust pollution. The spark plug includes a center electrode and a ground electrode. In one embodiment, the ground electrode has an elongate edge that extends past the major dimension of the center electrode. The elongate edge can either be positioned substantially tangentially to or within a "zone" outside of the center electrode's periphery. Preferably, the edge of the center electrode and the lower interior edge of the ground electrode will be presented towards one another such that the edges are or are among the closest portions within the sparking region.

20 Claims, 20 Drawing Sheets

U.S. PATENT DOCUMENTS

| | | | | |
|---|---|---|---|---|
| 1,175,176 | A | 3/1916 | Prescott | |
| 1,185,742 | A | 6/1916 | Walton | |
| 1,190,130 | A | 7/1916 | Duffy | 313/132 |
| 1,191,603 | A | 7/1916 | Loose | |
| 1,192,003 | A | 7/1916 | Schmidt | 313/141 |
| 1,221,922 | A | 4/1917 | Thomas | |
| 1,221,940 | A | 4/1917 | Witter | |
| 1,241,560 | A | 10/1917 | Schmidt | |
| 1,243,094 | A | 10/1917 | Olson | 313/126 |
| 1,253,584 | A | 1/1918 | Gerken | 313/140 |
| 1,258,269 | A | 3/1918 | St. James | |
| 1,274,002 | A | 7/1918 | Champlin | |
| 1,279,610 | A | 9/1918 | Taylor | |
| 1,279,974 | A | 9/1918 | Blomster et al. | 313/122 |
| 1,284,309 | A | 11/1918 | Gerken | |
| 1,307,088 | A | 6/1919 | Drummond | |
| 1,307,176 | A | 6/1919 | Benn | |
| 1,307,910 | A | 6/1919 | LeDanois | |
| 1,313,522 | A | 8/1919 | Cressy | |
| 1,317,663 | A | 9/1919 | Myers | |
| 1,324,875 | A | 12/1919 | Burgert | |
| 1,325,439 | A | 12/1919 | Dinger | |
| 1,336,914 | A | 4/1920 | Munster | |
| 1,337,216 | A | 4/1920 | Gates | |
| RE14,862 | E | 5/1920 | Duffy | 313/132 |
| 1,352,149 | A | 9/1920 | Schmidt | |
| 1,352,554 | A | 9/1920 | Synder | |
| 1,359,767 | A | 11/1920 | Thomas | |
| 1,359,996 | A | 11/1920 | Kahn | |
| 1,361,462 | A | 12/1920 | Hoffmann | |
| 1,362,504 | A | 12/1920 | Perry | |
| 1,366,602 | A | 1/1921 | Sharp | |
| 1,371,488 | A | 3/1921 | Jacobson | |
| 1,376,194 | A | 4/1921 | Ensign | |
| 1,442,423 | A | 1/1923 | Caspar | |
| 1,454,516 | A | 5/1923 | Lee | |
| 1,459,447 | A | 6/1923 | Gavlak | |
| 1,468,929 | A | 9/1923 | Strawser | |
| 1,476,350 | A | 12/1923 | Reynolds et al. | |
| 1,483,673 | A | 2/1924 | O'Connell | 313/139 |
| 1,486,710 | A | 3/1924 | Whittier | |
| 1,495,499 | A | 5/1924 | Stanislawski | |
| 1,518,462 | A | 12/1924 | Smith | |
| 1,522,929 | A | 1/1925 | Williams | |
| 1,533,979 | A | 4/1925 | Euler | |
| 1,534,986 | A | 4/1925 | Natoli | 313/132 |
| 1,547,546 | A | 7/1925 | Yarlott | |
| RE16,159 | E | 9/1925 | Fairchild | |
| 1,564,645 | A | 12/1925 | Thomas | |
| 1,576,176 | A | 3/1926 | Corey | |
| 1,579,625 | A | 4/1926 | Banghart | |
| 1,592,936 | A | 7/1926 | Jacomini | |
| 1,604,484 | A | 10/1926 | Rubert | |
| 1,622,760 | A | 3/1927 | Bourrieu | |
| 1,674,977 | A | 6/1928 | McElroy | |
| 1,689,707 | A | 10/1928 | Winters | |
| 1,748,338 | A | 2/1930 | Georgias | |
| 1,758,542 | A | 5/1930 | Stern | |
| 1,912,516 | A | 6/1933 | Davis | |
| 1,941,279 | A | 12/1933 | Sharpnack | |
| 1,942,242 | A | 1/1934 | Fitzgerald | |
| 1,977,038 | A | 10/1934 | Brand | |
| 1,989,670 | A | 2/1935 | Anthony | |
| 1,992,071 | A | 2/1935 | Healey | |
| 2,048,028 | A | 7/1936 | Rabezzana et al. | 313/118 |
| 2,120,492 | A | 6/1938 | Graf | |
| 2,164,578 | A | 7/1939 | Doyle et al. | |
| 2,173,607 | A | 9/1939 | Fowler | |
| 2,180,242 | A | 11/1939 | Kletz | |
| 2,266,999 | A | 12/1941 | Smith | |
| 2,270,765 | A | 1/1942 | Nowoslelski | |
| 2,294,248 | A | 8/1942 | Smulski | |
| 2,322,616 | A | 6/1943 | Carson et al. | |
| 2,391,459 | A | 12/1945 | Hensel | |
| 2,394,865 | A | 2/1946 | McCarthy et al. | |
| 2,487,535 | A | 11/1949 | Fernandez | |
| 2,494,788 | A | 1/1950 | Wetzel | |
| 2,497,862 | A | 2/1950 | Chuy | |
| 2,591,019 | A | 4/1952 | Simon | |
| 2,591,025 | A | 4/1952 | Tierney, Jr. et al. | |
| 2,597,718 | A | 5/1952 | Field | |
| 2,640,474 | A | 6/1953 | Phillips | 313/140 |
| 2,648,320 | A | 8/1953 | Phillips et al. | |
| 2,652,043 | A | 9/1953 | Johnson | 313/140 |
| 2,684,060 | A | 7/1954 | Schechter | |
| 2,815,463 | A | 12/1957 | Ludwig et al. | |
| 2,833,265 | A | 5/1958 | Hindle et al. | 313/118 |
| 2,843,780 | A | 7/1958 | Harper, Jr. | |
| 3,056,899 | A | 10/1962 | Clayton | |
| 3,515,925 | A | 6/1970 | Rickhey | |
| 3,659,137 | A | 4/1972 | Cataldo | |
| 3,710,168 | A | 1/1973 | Fernandez | 313/141 |
| 3,908,145 | A | 9/1975 | Kubo | |
| 3,940,649 | A | 2/1976 | Berstler | |
| 3,958,144 | A | 5/1976 | Franks | 313/138 |
| 3,965,384 | A | 6/1976 | Yamazaki | |
| 3,970,885 | A | 7/1976 | Kasima | 313/132 |
| 4,015,160 | A | 3/1977 | Lara et al. | |
| 4,023,058 | A | 5/1977 | Lara et al. | 313/139 |
| 4,028,576 | A | 6/1977 | Wofsey | |
| 4,029,986 | A | 6/1977 | Lara et al. | |
| 4,061,122 | A | 12/1977 | Edgar et al. | |
| 4,087,719 | A | 5/1978 | Pratt, Jr. | |
| 4,092,558 | A | 5/1978 | Yamada | |
| 4,093,887 | A | 6/1978 | Corbach et al. | |
| 4,101,797 | A | 7/1978 | Yamamoto et al. | 313/141 |
| 4,206,381 | A | 6/1980 | Wax | |
| 4,267,481 | A | 5/1981 | Sauder | 313/139 |
| 4,268,774 | A | 5/1981 | Forkum, Jr. | |
| 4,275,328 | A | 6/1981 | Watanabe et al. | |
| 4,288,714 | A | 9/1981 | Yamada et al. | |
| 4,329,174 | A | 5/1982 | Ito et al. | |
| 4,416,228 | A | 11/1983 | Benedikt et al. | |
| 4,439,707 | A | 3/1984 | Hattori et al. | |
| 4,439,708 | A | 3/1984 | Hattori et al. | |
| 4,484,101 | A | 11/1984 | Ibbott | 313/142 |
| 4,490,122 | A | 12/1984 | Tromeur | |
| 4,514,657 | A | 4/1985 | Igashira et al. | |
| 4,695,758 | A | 9/1987 | Nishida et al. | 313/130 |
| 4,700,103 | A | 10/1987 | Yamaguchi et al. | |
| 4,795,937 | A | 1/1989 | Wagner et al. | |
| 4,808,878 | A | 2/1989 | Kashiwara et al. | 313/141 |
| 4,906,889 | A | 3/1990 | Dibert | |
| 4,914,343 | A | 4/1990 | Kagawa et al. | |
| 4,914,344 | A | 4/1990 | Watanabe et al. | |
| 4,916,354 | A | 4/1990 | Forkum, Jr. | |
| 4,963,784 | A | 10/1990 | Niessner | |
| 4,970,426 | A | 11/1990 | Bronchart | |
| 4,983,877 | A | 1/1991 | Kashiwara et al. | 313/140 |
| 4,987,868 | A | 1/1991 | Richardson | |
| 5,007,389 | A * | 4/1991 | Kashiwara et al. | 313/141 |
| 5,051,651 | A | 9/1991 | Kashiwara et al. | 313/139 |
| 5,092,803 | A | 3/1992 | Johnson | |
| 5,101,135 | A | 3/1992 | Oshima | |
| 5,107,168 | A | 4/1992 | Friedrich et al. | |
| 5,113,806 | A | 5/1992 | Rodart | |
| 5,124,612 | A | 6/1992 | Takamura et al. | |
| 5,159,232 | A | 10/1992 | Sato et al. | |
| 5,189,333 | A | 2/1993 | Kagawa et al. | |
| 5,202,601 | A | 4/1993 | Takamura et al. | |
| 5,239,225 | A | 8/1993 | Moriya et al. | |

5,258,684 A 11/1993 Matesco
5,264,754 A 11/1993 Hanitijo et al.
5,280,214 A 1/1994 Johnson
5,347,193 A 9/1994 Oshima et al.
5,369,328 A 11/1994 Gruber et al. ..... 313/141
5,373,214 A 12/1994 McCready
5,395,273 A 3/1995 Matsutani
5,408,961 A 4/1995 Smith
5,430,346 A 7/1995 Johnson
5,448,130 A 9/1995 Matsutanti et al.
5,461,276 A 10/1995 Matsutani et al.
5,463,267 A 10/1995 Conway
5,493,171 A 2/1996 Wood, III et al.
5,497,045 A 3/1996 Matsutant et al. ..... 313/141
5,502,351 A 3/1996 Katoh et al. ..... 313/141
5,527,198 A 6/1996 Chiu et al.
5,557,158 A 9/1996 Kanao et al.
5,563,468 A 10/1996 Abe et al.
5,563,469 A 10/1996 Takamura et al.
5,574,329 A 11/1996 Kagawa
5,577,471 A 11/1996 Ward
5,578,894 A 11/1996 Oshima
5,581,145 A 12/1996 Kato et al.
5,610,470 A 3/1997 Wofsey
5,612,586 A 3/1997 Benedikt et al.
5,623,179 A 4/1997 Buhl
5,633,557 A 5/1997 Lindsay
5,650,987 A 7/1997 van den Bogaert
5,675,209 A 10/1997 Hall, Jr. et al.
5,680,002 A 10/1997 Kunitomo et al.
5,693,999 A 12/1997 Osamura et al.
5,731,654 A 3/1998 Benedikt et al.
5,731,655 A 3/1998 Corrado
5,736,809 A 4/1998 Matsutani et al. ..... 313/141
5,982,079 A * 11/1999 Kibbey ..... 313/141

* cited by examiner

SPARK PLUG

REFERENCE TO PRIOR APPLICATIONS

The present invention claims the benefit of and incorporates by reference the at following provisional patent applications:

Serial No. 60/076,669 Filed Mar. 2, 1998.

Serial No. 60/089,491 Filed Jun. 16, 1998.

Serial No. 60/089,499 Filed Jun. 16, 1998.

Serial No. 60/114,439 Filed Dec. 31, 1998.

TECHNICAL FIELD

The present invention generally relates to spark plugs for igniting the fuel charge in an internal combustion engine, and is particularly concerned with an improved spark plug construction which improves combustion pressure, fuel mileage and diminishes exhaust pollution as compared with known prior art plugs.

BACKGROUND OF THE INVENTION

Prior art spark plugs are well known. Such spark plugs typically include a center electrode and a ground electrode spaced apart from the center electrode. When a sufficient electrical potential is provided across the gap, a spark jumps across the gap. This spark can be used to ignite an air-fuel mixture within an internal combustion engine.

U.S. Pat. No. 5,051,651 ("the '651 patent") details a "cylindrical hole" that is created around the center electrode by shielding of the outer ground electrode. The '651 patent asserts that "ignition seeds" multiply inside of this cylindrical hole. The ground electrode, in all examples, has a "substantially concave inner surface complimenting the redial face of said center electrode" (Column 8, line 33). This creates a concentric curved surface that has an inner radius equal to "the sum of the radius of the center electrode and a spark gap can be nearly equal to the radius of the cylindrical hole" (Column 1, line 54).

As seen in FIG. 13 of the '651 patent, and in the language in independent Claim 18, the invention relies specifically on spark strike areas wherein "at least a portion of each said inner orthogonal sides is provided with a concave surface having a curvature complimenting the axial face of the center electrode".

Since all sparks travel along the shortest path, center electrode to ground electrode, the effective surfaces of the '651 patent are similar to other concentric ring designs (U.S. Pat. Nos. 1,748,338; 1,942,242; 1,912,516; 5,430,346; 5,280,214) where the ground electrode is shaped in a complimenting radius centered on the same axis as the center electrode. The '651 patent, at the functional core where the spark actually jumps, performs similarly to other concentric ring designs.

However, it is believed by the applicant that concentric ring designs have shown no performance benefit over standard spark plug designs.

Reference is also made to U.S. Pat. No. 5,612,586, in which particular importance is placed upon eliminating the 90 degree bend common to a standard spark plug.

The above prior art patents include some advantageous features. However, there is always a need for an improved plug design which provides improved fuel efficiency and reduced emissions.

SUMMARY OF THE INVENTION

The present invention relates to the use of a spark plug providing edge corners in a tangential relationship with the central electrode.

Therefore it is an object of the present invention to provide an improved spark plug.

It is a further object of the present invention to provide an improved spark plug ground electrode.

It is a further object of the present invention to provide an improved spark plug which exhibits improved fuel efficiency.

It is a further object of the present invention to provide an improved spark plug which exhibits improved combustion pressure.

It is a further object of the present invention to provide an improved spark lug which provides decreased pollution.

Other objects, feature, and advantages of the present invention will become apparent upon reading the following detailed description of the preferred embodiment of the invention when taken in conjunction with the drawings and the appended claims.

DETAILED DESCRIPTION OF THE PREFERRED EMBODIMENT

Generally described, the present invention is directed towards the use of a spark plug having a conventional center electrode and one or more ground electrodes, each of which defines at least one lower corner edge which is substantially tangentially oriented relative to the periphery of the substantially round electrode below.

Figure 1:
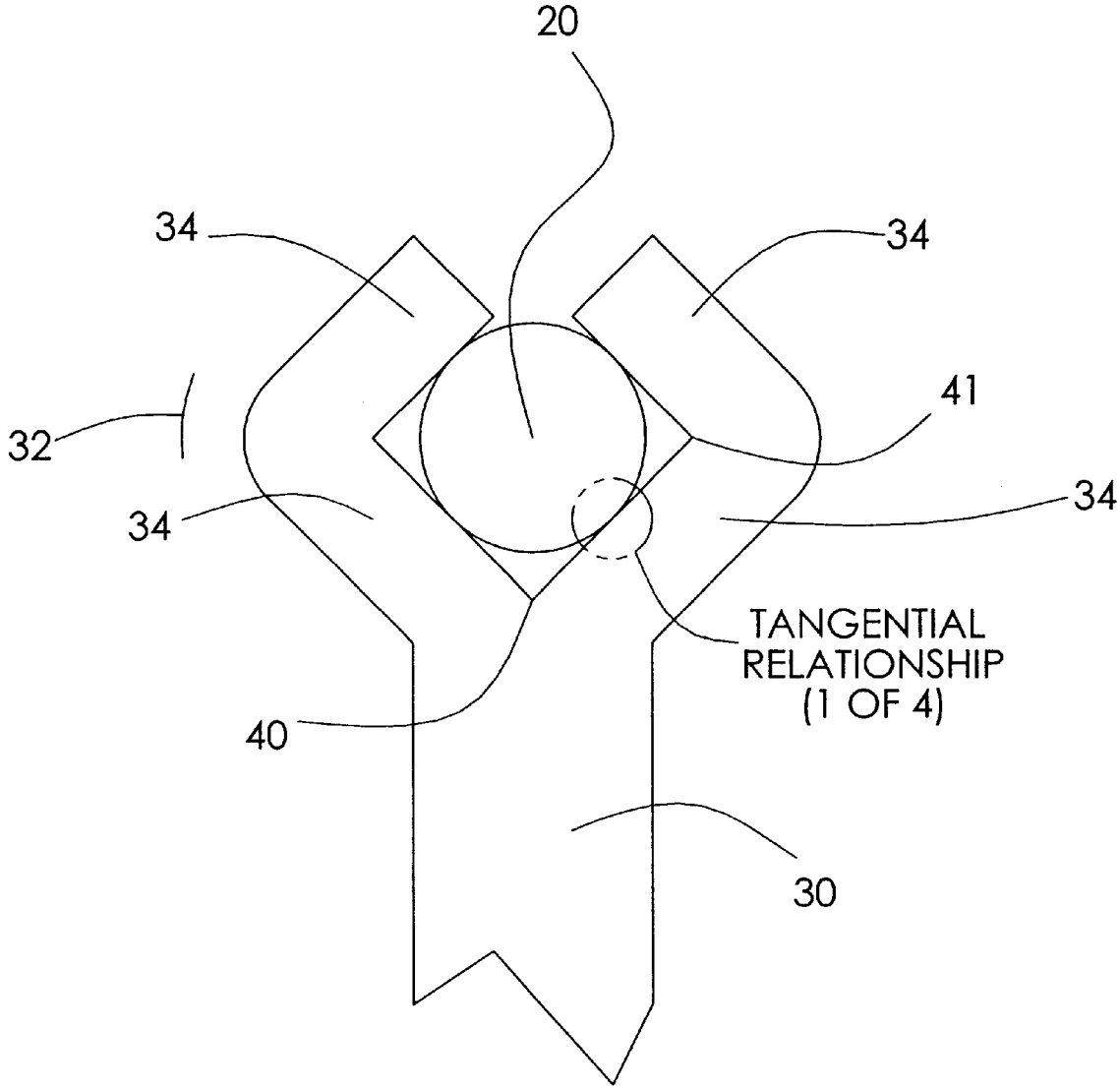
FIG. 1 is a top view of a portion of a first embodiment of the present invention shown in overall view in FIG. 2.
Figure 2:
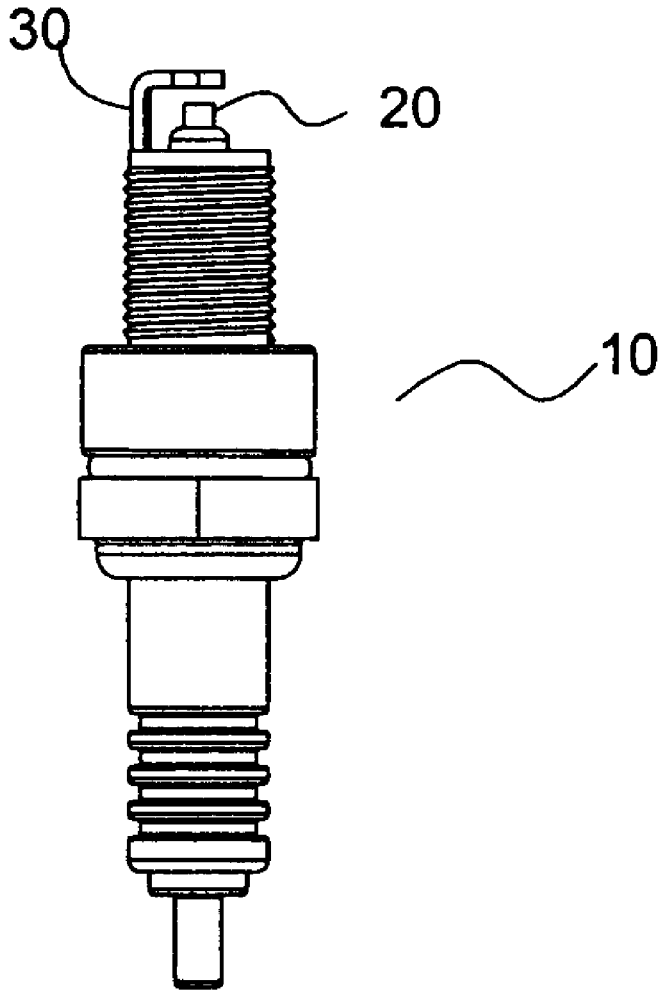
FIG. 2 is a side plan view of the first embodiment shown in FIG. 1, being a spark plug 10.

One configuration contemplated under the present invention can be referred. to as a "box" plug, shown in FIGS. 1 and 2. The "box" plug uses an electrode that is substantially in the shape of a square that appears to "encircle" the spark plug's center electrode, when viewed from above. However, in fact, as shown in FIG. 2, the box does not encircle the spark plug's center electrode, as there is a gap (0.025" in the case of one test) defined between the upper round end surface of the center electrode and the plane in which the downwardly-directed lower surfaces of the split prong members lie.

As may be seen, the electrode 30 includes two end prongs 32 which initially diverge but then eventually converge. The two end prongs 32 each include two segments 34 of substantially equal length. Two of these segments could be considered as the "diverging" segments 34, and the other two could be considered as the "converging" segments 34. This would mean that each prong includes one "diverging" segment and one "converging" segment.

An "Elbow" could be considered as connecting the diverging segment of a particular segment to its corresponding converging segment. Such elbows (two in the FIG. 1 version) are shown as being substantially in a vertical plane extending through the central longitudinal axis of the center prong.

The ground electrode could be considered to have three vertexes, a main vertex 40 and two elbow inner vertexes 41

It may be understood that the transverse cross sections of the segments 34 are substantially rectangular, being in one configuration 0.050" wide and 0.050" thick. Such a cross section provides four outwardly-directed, substantially linear (at least not near the bends) corner edges, (also shown in FIG. 14). It is believe that the relationship of at least the inner lower corner edges relative to the center electrode provides improved performance. Such a relationship will be referred to as a tangential relationship, with four tangential relationships provided in the FIG. 1 configuration, one for each segment 34.

It should be understood that the center electrode as shown in FIG. 2 shall be referenced in this Application as an "upwardly"-extending center electrode. However, this is for reference purposes only and should not be understood as limiting. In operation, such an electrode can be oriented in many different directions while in use.

OTHER EMBODIMENTS

Other ground electrode embodiments are contemplated under the present invention.

Figure 3:
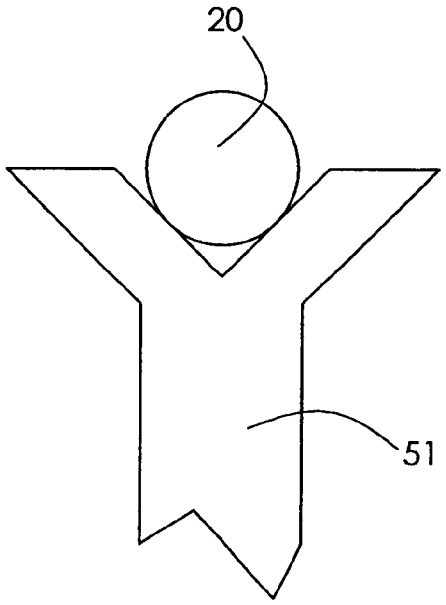
FIG. 3 is a top view of two electrodes, a ground electrode 51 and a center electrode 20, used in a second embodiment of the present invention, which could be considered a "forked" configuration, with two tangential relationships and one vertex.

FIG. 3 is a top view of two electrodes, a ground electrode 51 and a center electrode 20, used in a second embodiment of the present invention, which could be considered a "forked" configuration, with two tangential relationships and one vertex.

Figure 4:
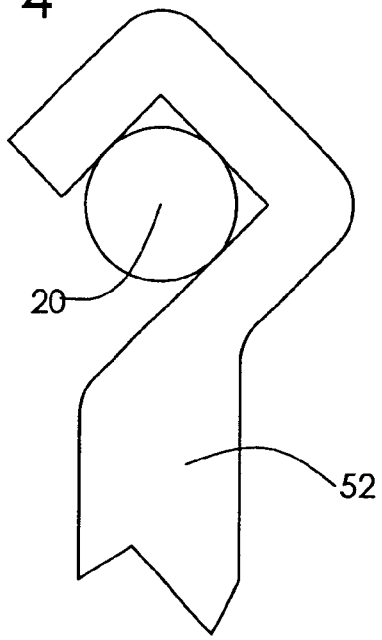
FIG. 4 is a top view of two electrodes, a ground electrode 52 and a center electrode 20, used in a third embodiment of the present invention, which includes three segments and three tangential relationships and two vertexes (a.k.a "vertices").

FIG. 4 is a top view of two electrodes, a ground electrode 52 and a center electrode 20, used in a third embodiment of the present invention, which includes three segments and three tangential relationships and two vertexes (a.k.a "vertices").

Figure 5:
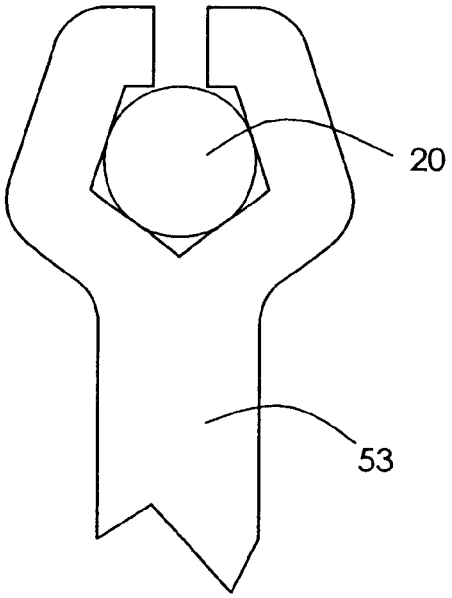
FIG. 5 is a top view of two electrodes, a ground electrode 53 and a center electrode 20, used in a fourth embodiment of the present invention, with six segments, up to five vertexes, and at least four tangential relationships.

FIG. 5 is a top view of two electrodes, a ground electrode 53 and a center electrode 20, used in a fourth embodiment of the present invention, with six segments, up to five vertexes, and at least four tangential relationships.

Figure 6:
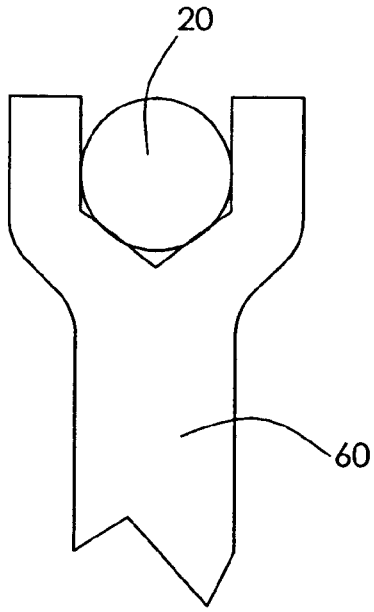
FIG. 6 is a top view of two electrodes, a ground electrode 60 and a center electrode 20, used in a fifth embodiment of the present invention, with four segments, three vertexes, and four tangential relationships.

FIG. 6 is a top view of two electrodes, a ground electrode 60 and a center electrode 20, used in a fifth embodiment of the present invention, with four segments, three vertexes, and four tangential relationships.

Figure 7:
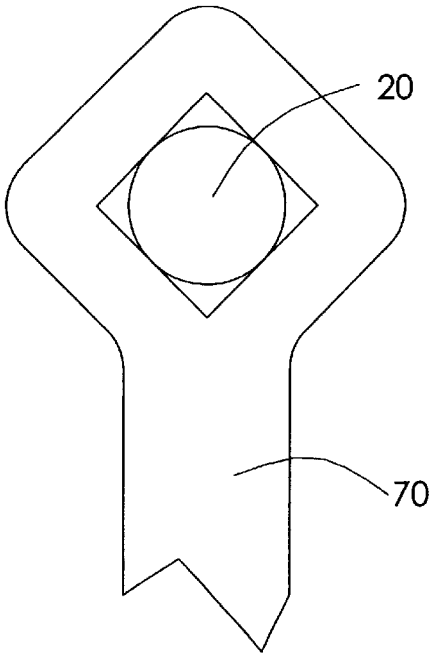
FIG. 7 is a top view of two electrodes, a ground electrode 70 and a center electrode 20, used in a sixth embodiment of the present invention, which could be considered a "closed box" configuration, with four tangential relationships and four vertexes.

FIG. 7 is a top view of two electrodes, a ground electrode 70 and a center electrode 20, used in a sixth embodiment of the present invention, which could be considered a "closed box" configuration, with four tangential relationships and four vertexes.

Figure 8:
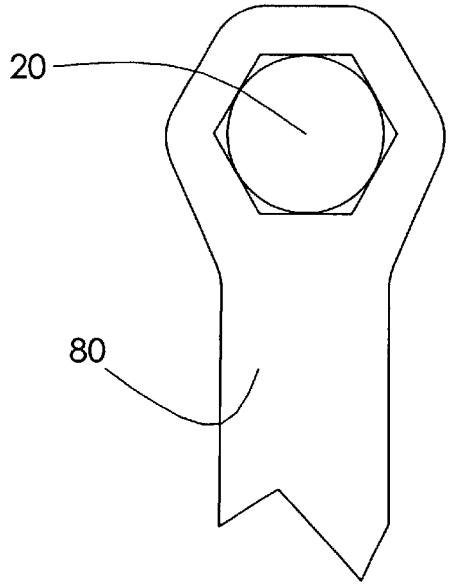
FIG. 8 is a top view of two electrodes, a ground electrode 80 and a center electrode 20, used in a seventh embodiment of the present invention, which could be considered a "closed hex box" configuration, with six tangential relationships and six vertexes.

FIG. 8 is a top view of two electrodes, a ground electrode 80 and a center electrode 20, used in a seventh embodiment of the present invention, which could be considered a "closed hex box" configuration, with six tangential relationships and six vertexes.

Figure 9:
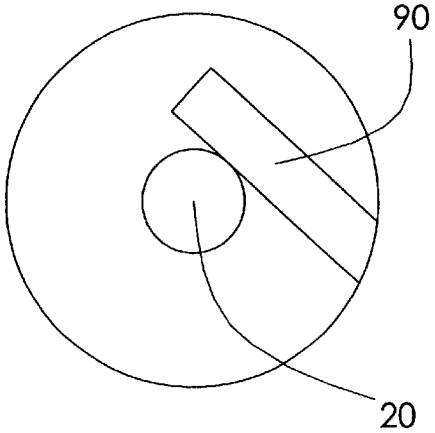
FIG. 9 is a top view of two electrodes, a ground electrode 90 and a center electrode 20, used in a eighth embodiment of the present invention, which could be considered a "single offset straight electrode" configuration, with one tangential relationship.

FIG. 9 is a top view of two electrodes, a ground electrode 90 and a center electrode 20, used in a eighth embodiment of the present invention, which could be considered a "single offset straight electrode" configuration, with one tangential relationship.

Figure 10:
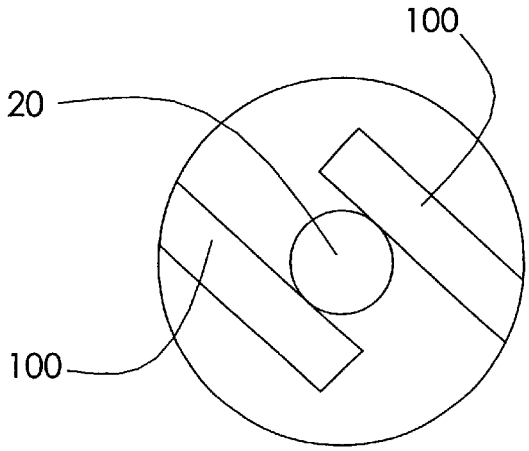
FIG. 10 is a top view of three electrodes, two ground electrodes 100, 101, and a center electrode 20, used in a ninth embodiment of the present invention, which could be considered a "double offset straight electrode" configuration, with two tangential relationships.

FIG. 10 is a top view of three electrodes, two ground electrodes 100, 101, and a center electrode 20, used in a ninth embodiment of the present invention, which could be considered a "double offset straight electrode" configuration, with two tangential relationships.

Figure 11:
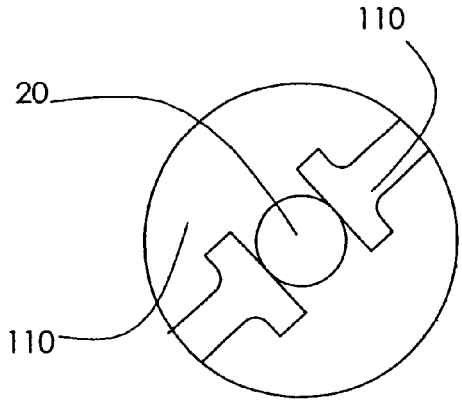
FIG. 11 is a top view of three electrodes, two ground electrodes 110, 111, and a center electrode 20 used in a tenth embodiment of the present invention, which could be considered a "double T electrode" configuration, with two tangential relationships.

FIG. 11 is a top view of three electrodes, two ground electrodes 110, 111, and a center electrode 20 used in a tenth embodiment of the present invention, which could be considered a "double T electrode" configuration, with two tangential relationships.

Figure 12:
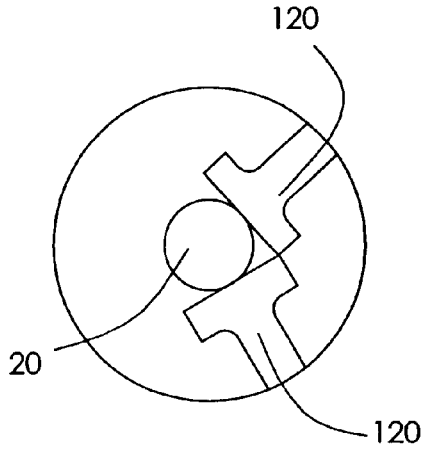
FIG. 12 is a top view of three electrodes, two ground electrodes 120, 121, and a center electrode 20 used in a eleventh embodiment of the present invention, which could be considered an "offset double T electrode" configuration, with two tangential relationships.

FIG. 12 is a top view of three electrodes, two ground electrodes 120, 121, and a center electrode 20 used in a eleventh embodiment of the present invention, which could be considered an "offset double T electrode" configuration, with two tangential relationships.

Figure 13:
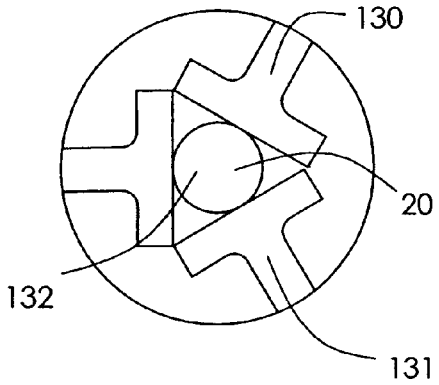
FIG. 13 is a top view of four electrodes, three ground electrodes 130, 131, and 132 and a center electrode 20 used in a eleventh embodiment of the present invention, which could be considered a "triangulated triple T electrode" configuration, with three tangential relationships.

FIG. 13 is a top view of four electrodes, three ground electrodes 130, 131, and 132 and a center electrode 20 used in a eleventh embodiment of the present invention, which could be considered a "triangulated triple T electrode" configuration, with three tangential relationships.

Figure 14:
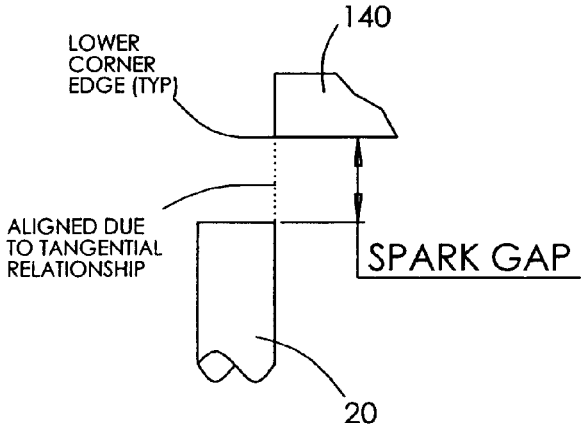
FIG. 14 is a side elevational view of a typical center electrode 20, shown underneath a cross-sectional view of a portion of a ground electrode 140, including a lower corner edge directed towards the center electrode in a tangential relationship.

FIG. 14 is a side elevational view of a typical center electrode 20, shown underneath a cross-sectional view of a portion of a ground electrode 140, including a lower corner edge directed, towards the center electrode in a tangential relationship.

Figure 15:
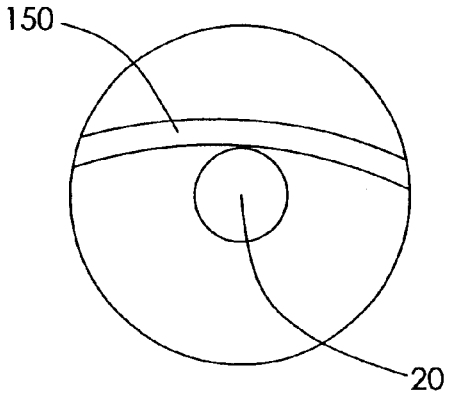
FIG. 15 shows a ground electrode 150 providing a simple convex curved edge presented to the center electrode 20, with one tangential edge relationship. The transverse cross-section of the ground electrode is rectangular.

FIG. 15 shows a ground electrode 150 providing a simple convex curved edge presented to the center electrode 20, with one tangential edge relationship. The transverse cross-section of the ground electrode is rectangular.

Figure 16:
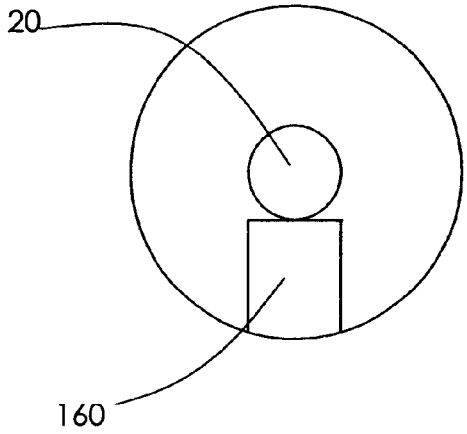
FIG. 16 shows a simple straight edge presented to the center electrode. One tangential edge relationship is shown. The cross-section of the ground electrode is rectangular.

FIG. 16 shows a simple straight edge presented to the center electrode. One tangential edge relationship is shown. The cross-section of the ground electrode is rectangular.

Figure 17:
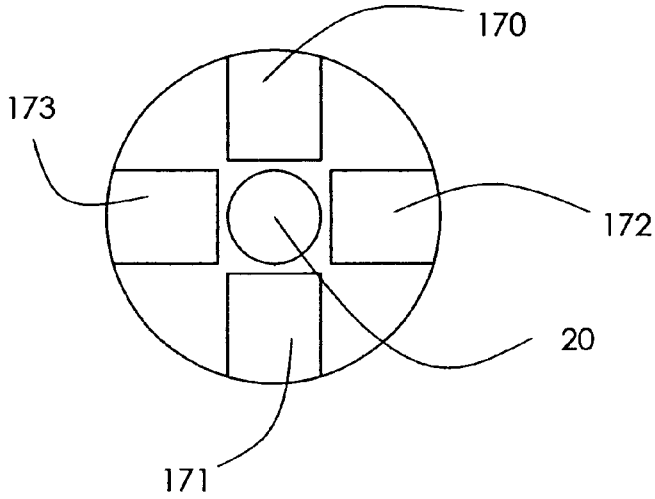
FIG. 17 shows the use of four ground electrodes 170, 171, 172 and 173, which combine to present multiple simple straight edges presented to the center electrode 20. No tangential edge relationships are shown in this figure, although four edges could be in the zone referenced in FIG. 26. The cross-section of each of the four ground electrodes is rectangular.

FIG. 17 shows the use of four ground electrodes 170, 171, 172 and 173, which combine to present multiple simple straight edges presented to the center electrode 20. No tangential edge relationships are shown in this figure. The cross-section of each of the four ground electrodes is rectangular.

Figure 18:
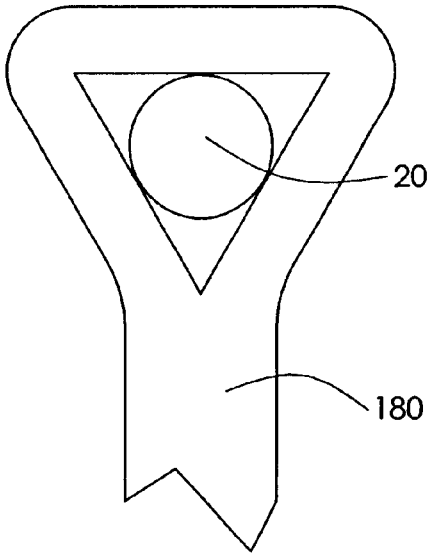
FIG. 18 shows a triangular-shaped ground electrode 180 presenting three edges and three vertexes to the center electrode 20. Three tangential edge relationships are shown. The transverse cross-section of each linear segment of the ground electrode is substantially rectangular.

FIG. 18 shows a triangular-shaped ground electrode 180 presenting three edges and three vertexes to the center electrode 20. Three tangential edge relationships are shown. The transverse cross-section of each linear segment of the ground electrode is substantially rectangular.

Figure 19:
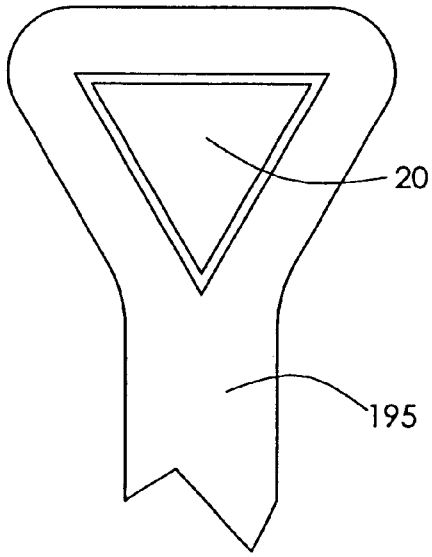
FIG. 19 is similar to that shown in FIG. 11, and shows a triangular-shaped ground electrode 190, but with a triangular center electrode 195. Three tangential edge relationships and three vertexes are shown in this figure.

FIG. 19 is similar to that shown in FIG. 11, and shows a triangular-shaped ground electrode 190, but with a triangular center electrode 195. Three tangential edge relationships and three vertexes are shown in this figure.

Figure 20:
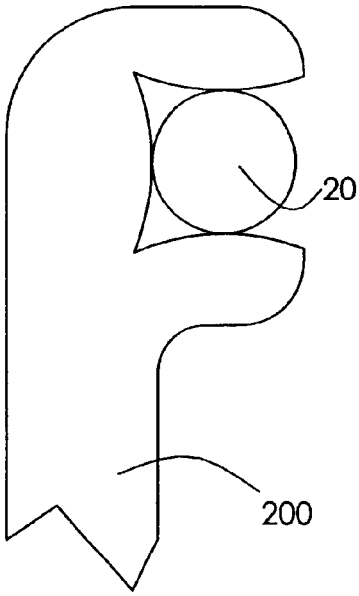
FIG. 20 is an open ended design including a ground electrode 200 presenting three curved edges and two vertexes to the center electrode 20. Three "curved" tangential edge relationships are provided under this configuration. Note that a tangential relationship can be a "straight" tangential relationship or can include a "curved" tangential relationship.

FIG. 20 is an open ended design including a ground electrode 200 presenting three curved edges and two vertexes to the center electrode 20. Three "curved" tangential edge relationships are provided under this configuration. Note that a tangential relationship can be a "straight" tangential relationship or can include a "curved" tangential relationship.

Figure 21:
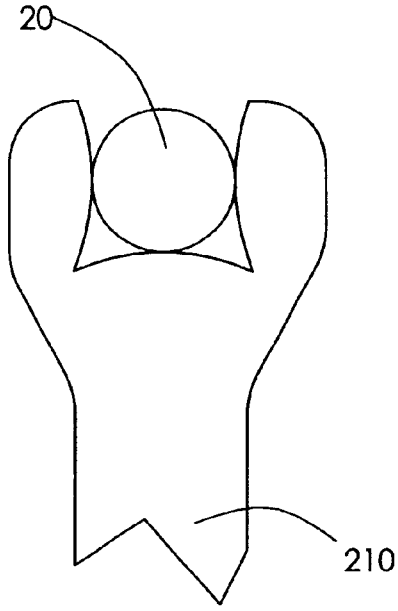
FIG. 21 is an open ended design including a ground electrode 210 presenting three straight edges and two vertexes to the center electrode 20. Three tangential edge relationships and two vertexes are shown in this figure.

FIG. 21 is an open ended design including a ground electrode 210 presenting three straight edges and two vertexes to the center electrode 20. Three tangential edge relationships and two vertexes are shown in this figure.

Figure 22:
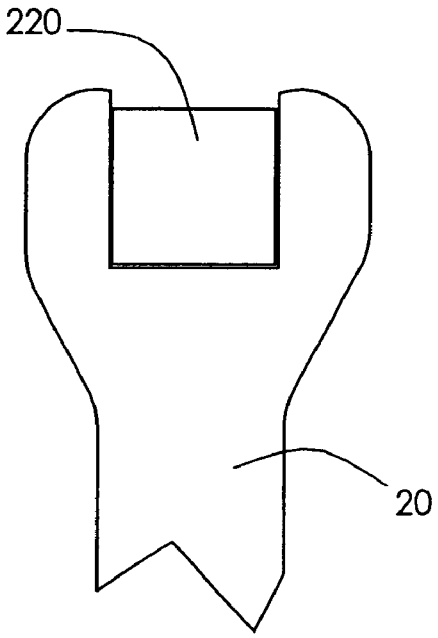
FIG. 22 is an open ended design similar to that shown in FIG. 21, except with a center electrode 225 shape that substantially matches the ground electrode 220 geometry, which in this case is square. Three tangential relationships are shown.

FIG. 22 is an open ended design similar to that shown in FIG. 21, except with a center electrode 225 shape that substantially matches the ground electrode 220 geometry, which in this case is square. Three tangential relationships are shown.

Figure 23:
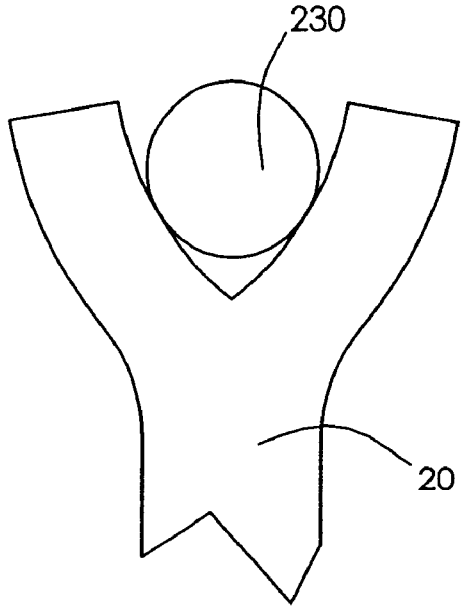
FIG. 23 shows a "forked" design, in which two curved tangential edge relationships exist, with a single vertex therein. A ground electrode 220 and a center electrode 230 are shown.

FIG. 23 shows a "forked" design, in which two curved tangential edge relationships exist, with a single vertex therein. A ground electrode 220 and a center electrode 230 are shown.

Figure 24:
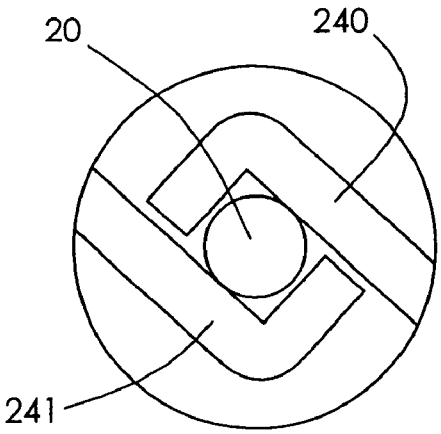
FIG. 24 shows two ground electrodes 240, each having a "barb" at their end, which serve to substantially surround the projection of the center electrode 20. Four straight tangential relationships and two vertexes are shown in this figure.

FIG. 24 shows two ground electrodes 240, each having a "barb" at their end, which serve to substantially surround the projection of the center electrode 20. Four straight tangential relationships and three vertexes are shown in this figure.

Figure 25:
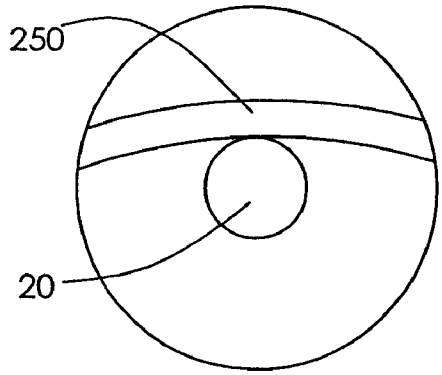
FIG. 25 shows a simple concave curved edge presented to the center electrode 20 by a ground electrode 250.

FIG. 25 shows a simple curved edge presented to the center electrode 20 by a ground electrode 250.

Figure 26:
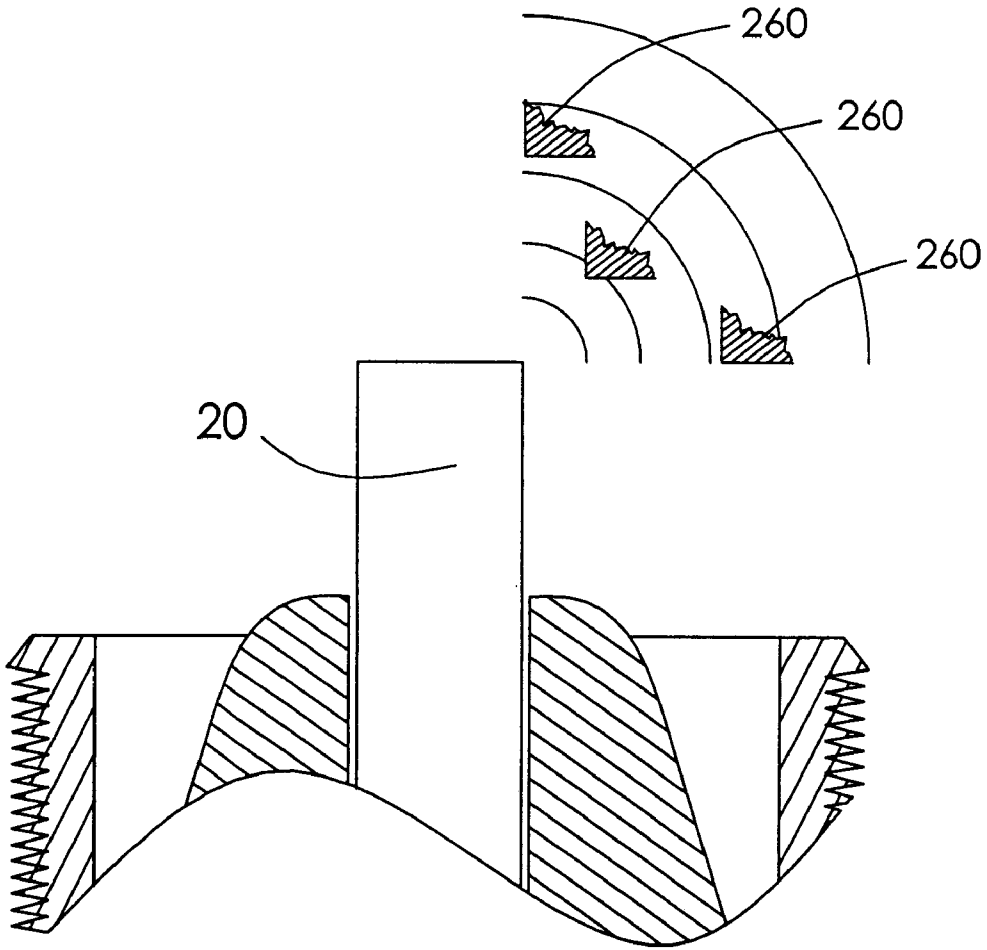
FIG. 26 is a side view illustrating various positions 1, 2 and 3 that a ground electrode 260 may be placed relative to the center electrode, with these three positions 1, 2 and 3 being within a "zone". The positions within the zone provide such that any of the positions expose the lower edge of the ground electrode to the center electrode's outer edge, which can create a "chimney" effect for the intake gases.

FIG. 26 is a side view illustrating various positions 1, 2 and 3 that a ground electrode 260 may be placed relative to the center electrode, with these three positions 1, 2 and 3 being within a "zone". The positions within the zone provide such that any of the positions expose the lower edge of the ground electrode to the center electrode's outer edge, which can create a "chimney" effect for the intake gases.

Figure 27:
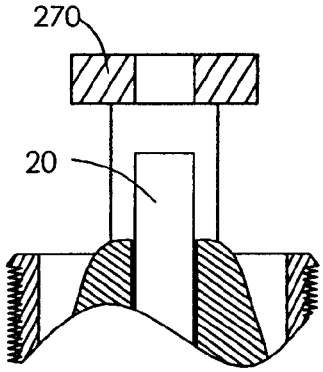
FIG. 27 is a side cross-sectional view of the embodiment shown in FIG. 1 (taken through the center longitudinal axis of the center electrode 20) with the lower edges of the ground electrode 270 presented above the center electrode in a substantially tangential relationship to the peripheral projection of the center electrode.

FIG. 27 is a side cross-sectional view of the embodiment shown in FIG. 1 (taken through the center longitudinal axis of the center electrode 20) with the lower edges of the ground electrode 270 presented above the center electrode in a substantially tangential relationship to the peripheral projection of the center electrode.

Figure 28:
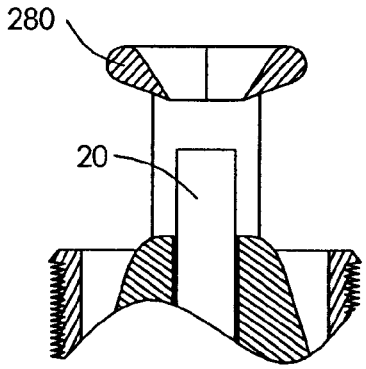
FIG. 28 is a view similar to FIG. 27, but the cross-section of the ground electrode 280 has been streamlined to offer less resistance to the flame front's propagation.

FIG. 28 is a view similar to FIG. 27, but the cross-section of the ground electrode 280 has been streamlined to offer less resistance to the flame front's propagation.

Figure 29:
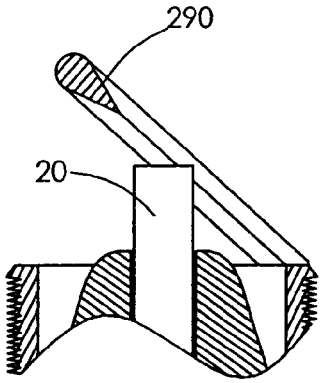
FIG. 29 is a view similar to that of FIG. 28, but the ground electrode 290 has been reduced to a single edge, and supported by an arc, as seen in electrode design shown in FIG. 25. Such a design could also apply to the view of FIG. 15. The cross-section could be of any shape other than that shown, that presents an edge (straight or otherwise) as the closest surface to the top edges of the center electrode 20.

FIG. 29 is a view similar to that of FIG. 28, but the ground electrode 290 has been reduced to a single edge, and supported by an arc, as seen in electrode design shown in FIG. 25. Such a design could also apply to the view of FIG. 15. The cross-section could be of any shape other than that shown, that presents an edge (straight or otherwise) as the closest surface the top edges of the center electrode 20.

Figure 30:
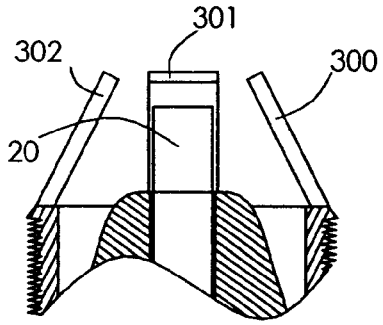
FIG. 30 shows an embodiment including multiple ground electrodes 300, 301, and 302 (a fourth ground electrode , not shown, may also be used) which provides multiple straight edges presented to the center electrode's top via straight ground electrodes angled upwardly and inwardly. The angle is not believed to be as important as the final position of the edges of the tips of the elongate members.

FIG. 30 shows an embodiment including multiple ground electrodes 300, 301, and 302 (a fourth ground electrode, not shown, may also be used) which provides multiple straight edges presented to the center electrode's top via straight ground electrodes angled upwardly and inwardly. The angle is not believed to be as important as the final position of the edges of the tips of the elongate members.

Figure 31:
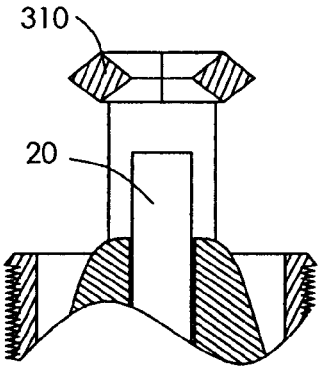
FIG. 31 is a side cross-sectional view of a configuration generally similar to that shown in, for example, FIG. 1, except the cross-section of the ground electrode 310 has a "diamond" shape, presenting. edges to the top circular edge of the center electrode 20. This design could promote better flow for the flame resulting from the spark ignition due to the chamfers above and below the ground electrode edges.

FIG. 31 is a side cross-sectional view of a configuration generally similar to that shown in, for example, FIG. 1, except the cross-section of the ground electrode 310 has a "diamond" shape, presenting edges to the top circular edge of the center electrode 20. This design could promote better flow for the flame resulting from the spark ignition due to the chamfers above and below the ground electrode edges.

Figure 32:
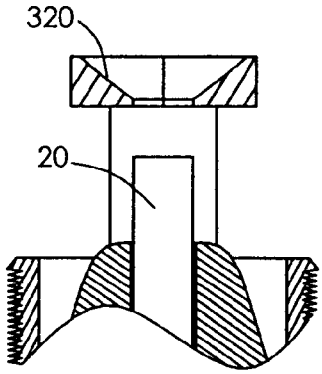
FIG. 32 is a modification of that shown in FIG. 1, except a simple chamfer is provided on the top surface of the ground electrode 320. This could gain some of the benefits of the design shown in FIG. 31, but would appear to be easier to manufacture.

FIG. 32 is a modification of that shown in FIG. 1, except a simple chamfer is provided on the top surface of the ground electrode 320. This could gain some of the benefits of the design shown in FIG. 31, but would appear to be easier to manufacture.

Figure 33:
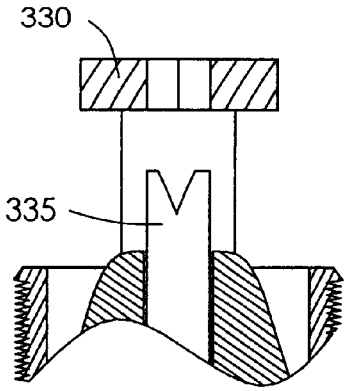
FIG. 33 is a view of an embodiment including a ground electrode which is similar to FIG. 1, except that a simple notch has been cut into the center electrode 335 to improve spark efficiency.

FIG. 33 is a view of an embodiment including a ground electrode which is similar to FIG. 1, except that a simple notch has been cut into the center electrode 335 to improve spark efficiency.

Figure 34:
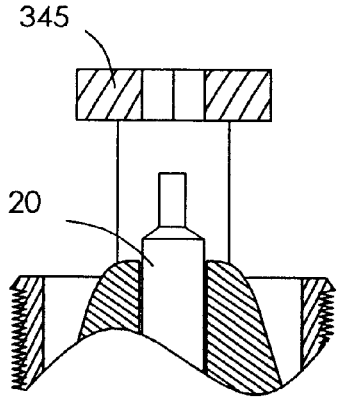
FIG. 34 is a side cross-sectional view of an embodiment similar to that of FIG. 1, including a ground electrode 340, except that a "necked-down" section is provided at the top of the center electrode 345, creating a "fine wire" discharge tip to the center electrode.

FIG. 34 is a side cross-sectional view of an embodiment similar to that of FIG. 1, including a ground electrode 340, except that a "necked-down" section is provided at the top of the center electrode 345, creating a "fine wire" discharge tip to the center electrode.

Figure 35:
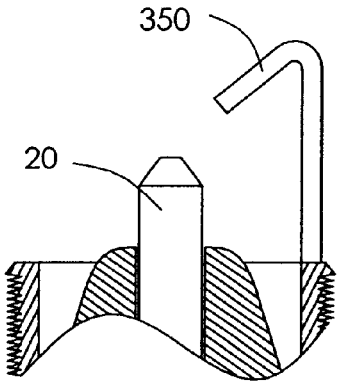
FIG. 35 shows a ground electrode 350 edge presented from above, through single (as shown) or multiple (not shown) stems that support the "important" edge Also, the center electrode 355 has a chamfer at the tip.

FIG. 35 shows a ground electrode 350 edge presented from above, through single (as shown) or multiple (not shown) stems that support the "important" edge Also, the center electrode 355 has a chamfer at the tip.

Figure 36:
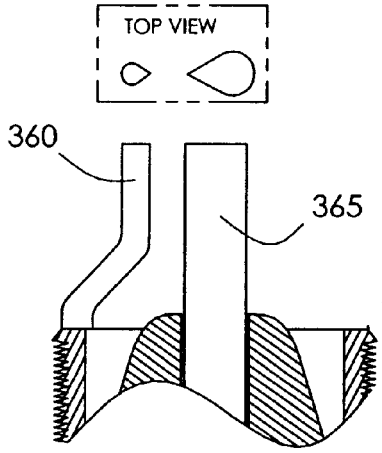
FIG. 36 shows a top and side view configuration which includes "maximized edge-to-edge presentation" of two edges defined by the center and ground electrodes 365 and 360, respectively. While possibly more expensive to manufacture than other embodiments, this design presents a less shielded edge-to-edge spark to the combustion chamber. The small sizes of the electrodes are also believed to serve to reduce blockage to the incoming fuel charge and the existing flame kernel.

FIG. 36 shows a top and side view configuration which includes "maximized edge-to-edge presentation" of two edges defined by the center and ground electrodes 365 and 360, respectively. While possibly more expensive to manufacture than other embodiments, this design presents a less shielded edge-to-edge spark to the combustion chamber. The small sizes of the electrodes are also believed to serve to reduce blockage to the incoming fuel charge and the existing flame kernel.

Figure 37:
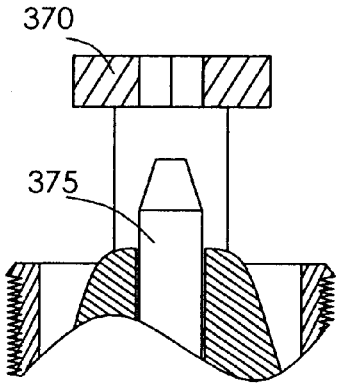
FIG. 37 is a view of a spark plug having a ground electrode 370 similar to that of FIGS. 1 and 2, except that a chisel point center electrode 375 is used.

FIG. 37 is a view of: a spark plug having a ground electrode 370 similar to that of FIGS. 1 and 2, except that a chisel point center electrode 375 is used.

Figure 38:
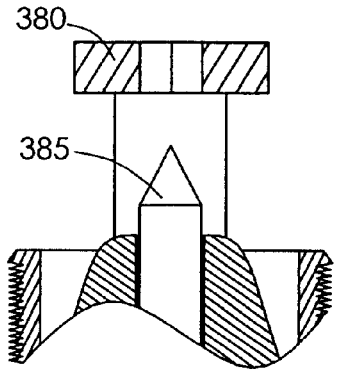
FIG. 38 is a view of a spark plug having a single point center electrode 385, with a ground electrode 380 being similar to that shown in FIGS. 1 and 2.

FIG. 38 is a view of a spark plug having a single point center electrode 385, with a ground electrode 380 being similar to that shown in FIGS. 1 and 2.

Figure 39:
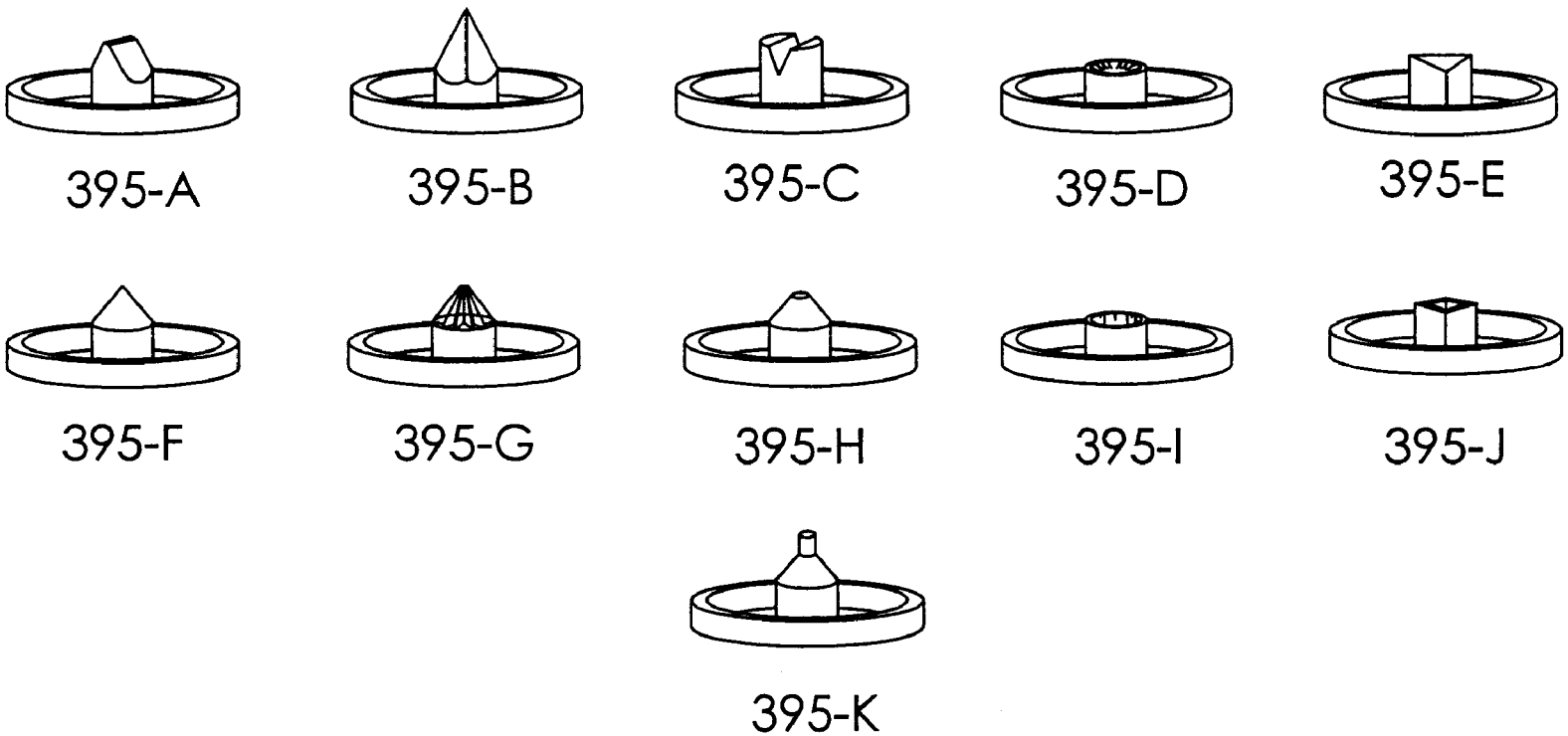
FIG. 39 is a view of a series of center electrode configurations which may be used with other ground electrodes within this description, including a chisel point 395-A, pyramid point 395-B, a V-groove 395-C, a dimpled center 395-D, a polygon 395-E, a single point 395-F, multiple edges 395-G, a chamfer point 395-H, a hollow cylinder 395-I, a hollow polygon 395-J,and a necked down configuration 395-K.

FIG. 39 is a view of a series of center electrode configurations which may be used with other ground electrodes within this description, including a chisel point 395A, pyramid point 395-B, a V-groove 395-C, a dimpled center 395-D, a polygon 395-E, a single point 395-F, multiple edges 395-G, a chamfer point 395-H, a hollow cylinder 395-I, a hollow polygon 395-J,and a necked down configuration 395-K.

Figure 40A:
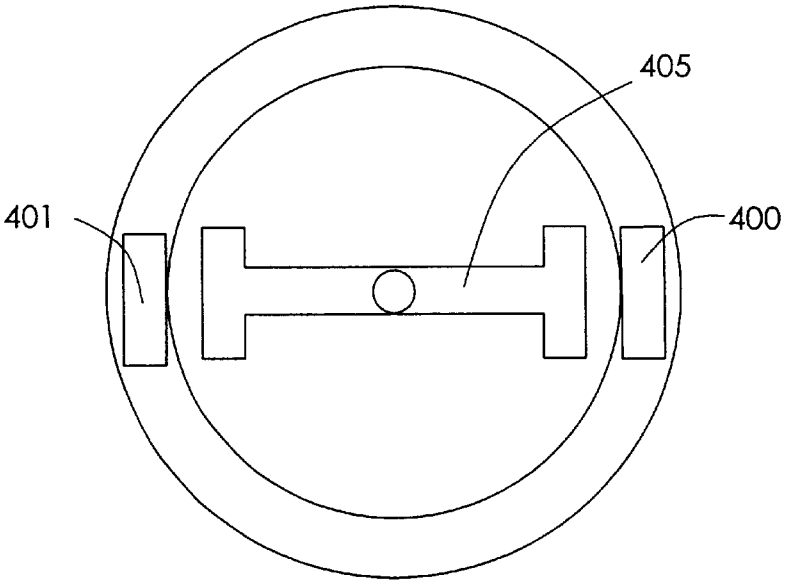
FIGS. 40A and B are top and side plan views, respectively, of a configuration including a T-shaped center electrode 405 having T-shaped ends each defining an edge, and a pair of ground electrodes 400, 401 likewise each defining an edge. The edges of the center electrode are presented to the edges of the ground electrodes in a one-to-one relationship.

FIGS. 40A and B are top and side plan views, respectively, of a configuration including a T-shaped center electrode 405 having T-shaped ends each defining an edge, and a pair of ground electrodes 400, 401 likewise each defining an edge. The edges of the center electrode are presented to the edges of the ground electrodes in a one-to-one relationship.

Figure 41A:
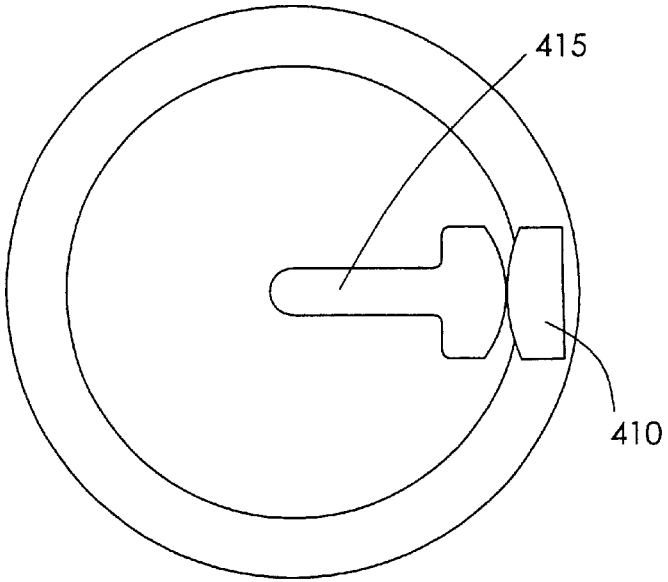
FIGS. 41A and 41B are top and side plan views, respectively, of a configuration including the L-shaped center electrode 415 and a ground electrode 410, with curved tangential edges. Note that two segments could be used such as in FIGS. 40A and 40B, or more than two segments could be used, either with this configuration or the FIGS. 40A/40B configuration.
Figure 41B:
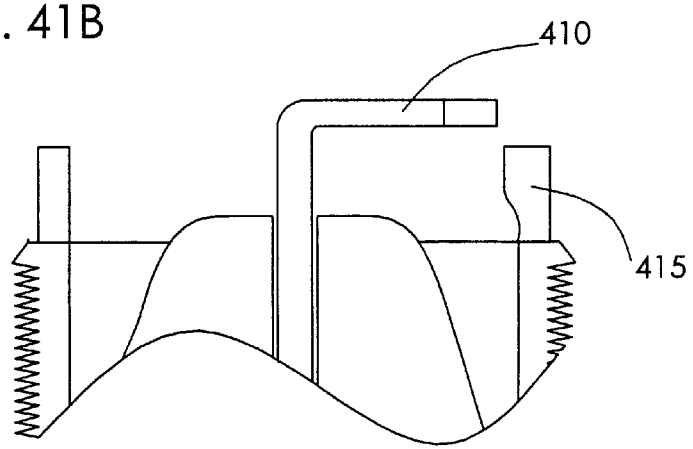
Figure 40B:
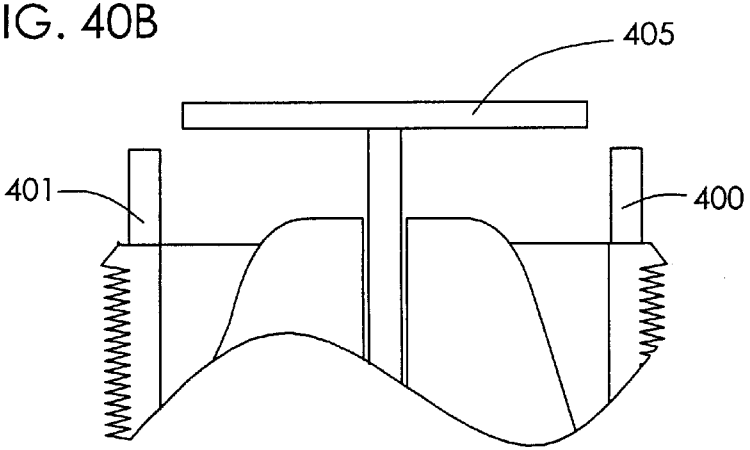

FIGS. 41A and 41B are top and side plan views, respectively, of a configuration including the L-shaped center electrode 415 and a ground electrode 410, with curved tangential edges. Note that two segments could be used such as in FIGS. 40A and 40B, or more than two segments could be used, either with this configuration or the FIGS. 40A/40B configuration.

Figure 42A:
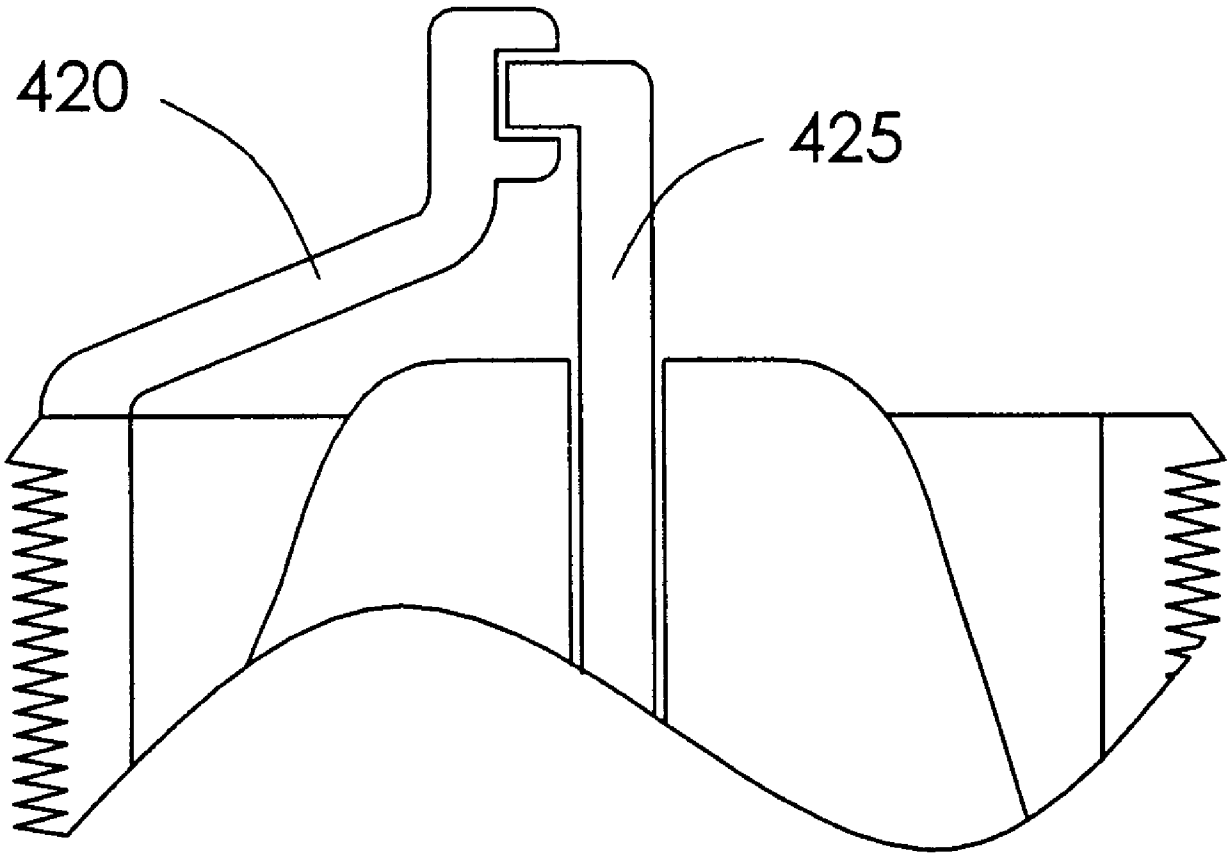
FIGS. 42A/42B show a configuration which includes a center electrode 425 and a ground electrode 420, combining to form three tangential relationships.
Figure 42B:
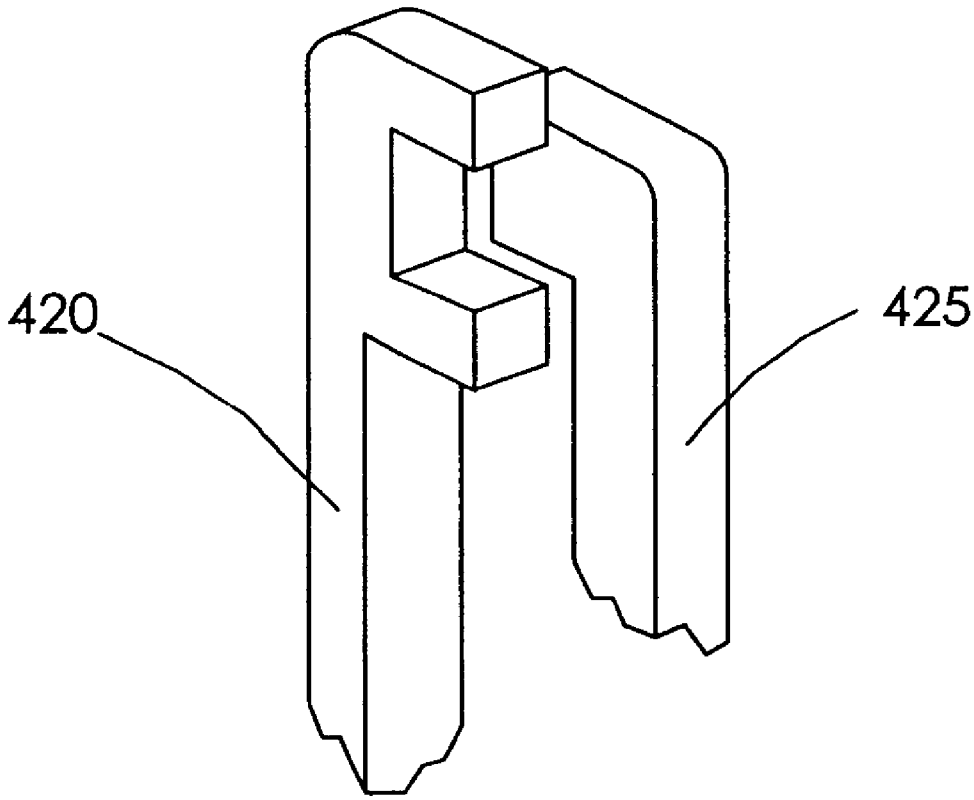

FIGS. 42A/42B show a configuration which includes a center electrode 425 and a ground electrode 420, combining to form three tangential relationships.

Figure 43:
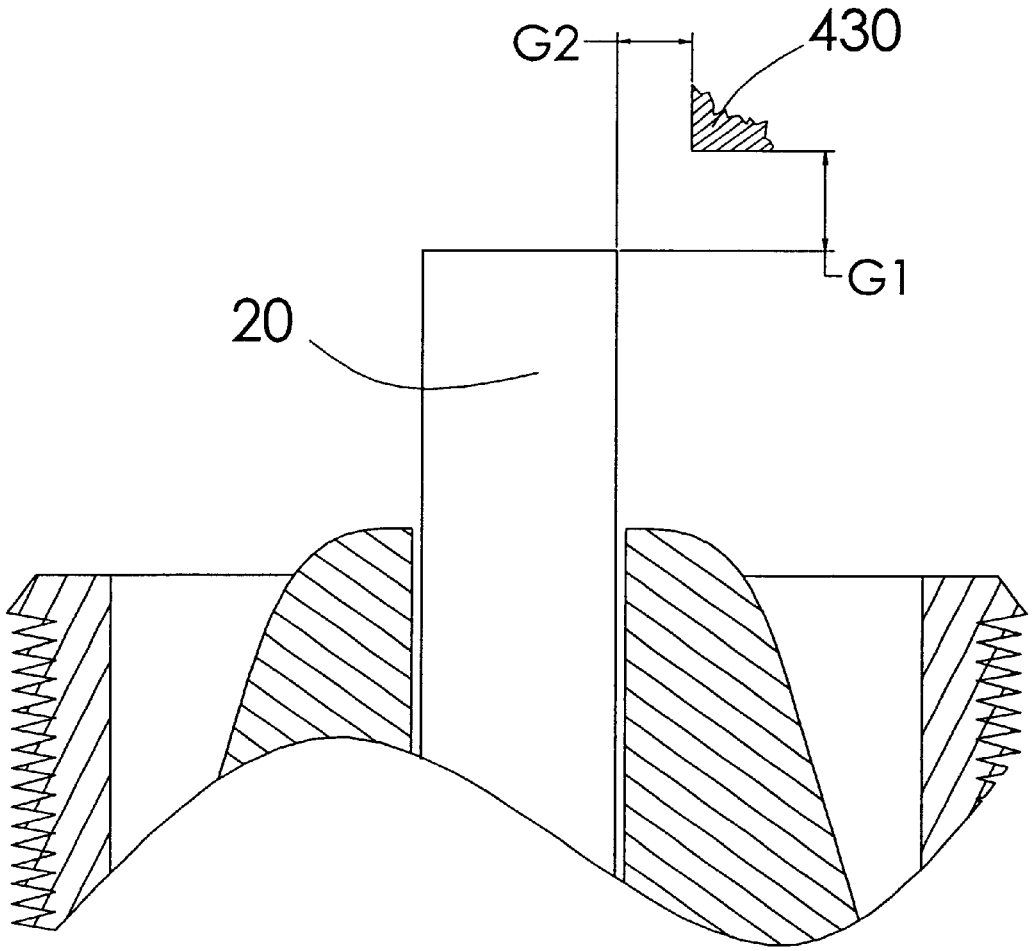
FIG. 43 is a configuration which includes a center electrode 20 and a ground electrode 430, which provides vertical and horizontal spacing between the two points referenced as G1 and G2, respectively. Preferably G1 is greater than or equal to zero and G2 is greater than or equal to zero. As shown in the figures, specifically in FIG. 26, if G1 is zero, G2 must be greater than zero, and if G2 is zero, G1 must be greater than zero. This is another way to illustrate the "zone" concept of FIG. 26.

FIG. 43 is a configuration which includes a center electrode 20 and a ground electrode 430, which provides vertical and horizontal spacing between the two referenced as G1 and G2, respectively. Preferably G1 is greater than or equal to zero and G2 is greater than or equal to zero. This is another way to illustrate the "zone" concept of FIG. 26.

Figure 44:
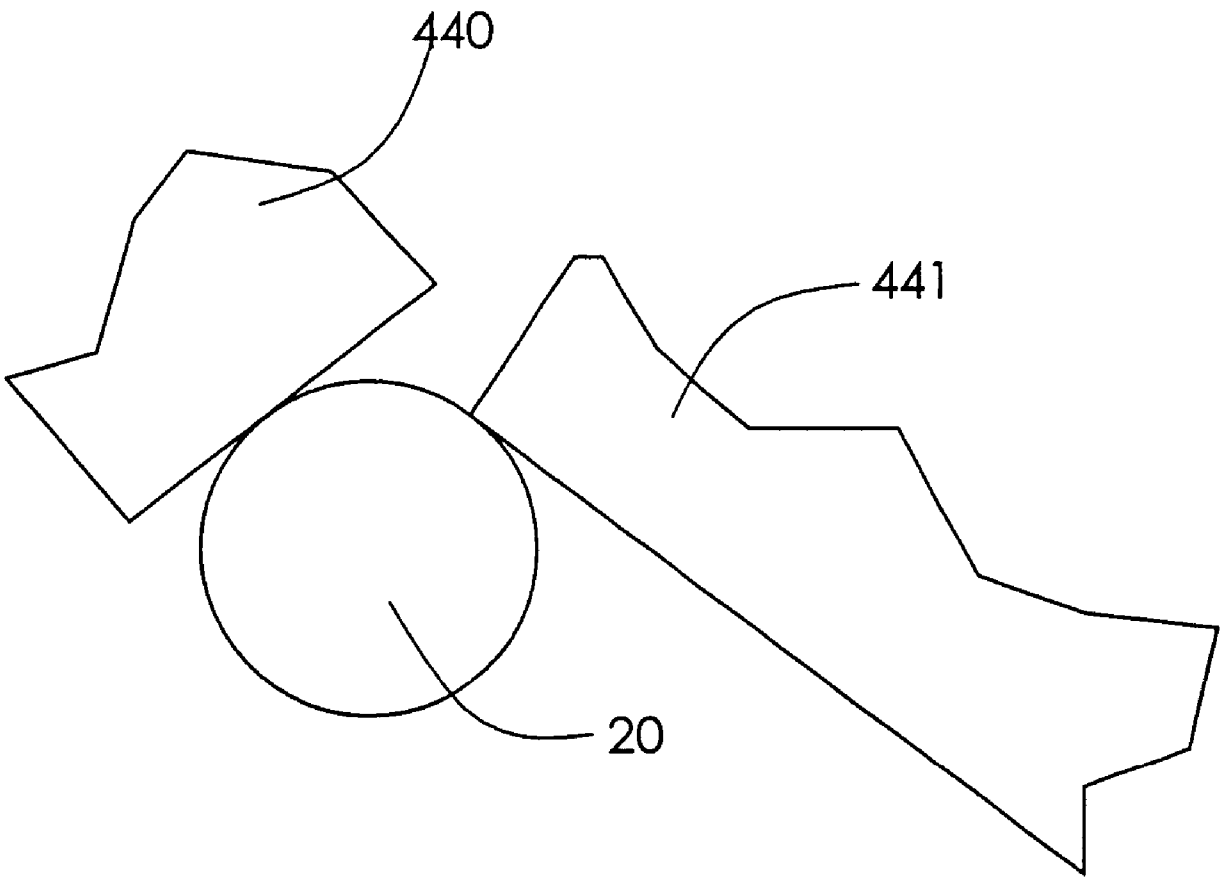
FIG. 44 is an illustrative top plan view of an exemplary center electrode 20 and two exemplary ground electrodes 440, 441, further illustrating the tangential relationship which is one feature of the present invention. As may be seen, a "tangential" relationship includes not only the "case 1" relationship of the elements 20, 440, but also the "case 2" relationship of the elements 20, 441.

FIG. 44 is an illustrative top plan view of an exemplary center electrode 20 and two exemplary ground electrodes 440, 441, further illustrating the tangential relationship which is one feature of the present invention. As may be seen, a "tangential" relationship includes not only the "case 1" relationship of the elements 20, 440, but also the "case 2" relationship of the elements 20, 441.

Figure 45:
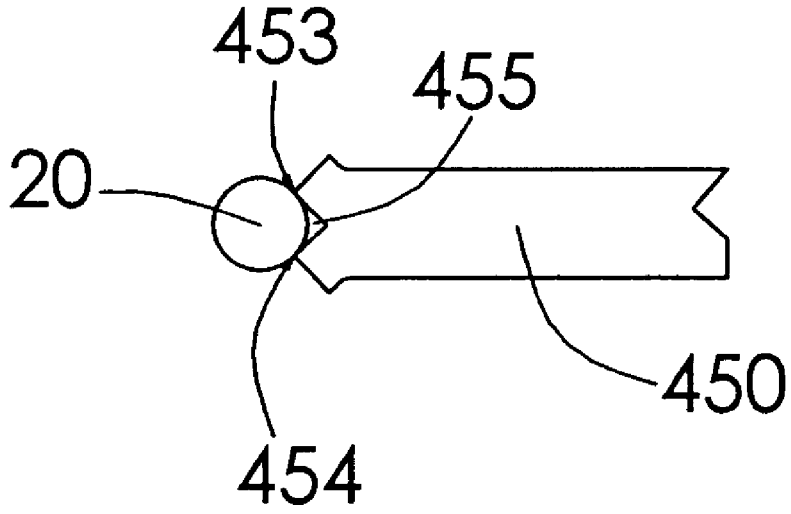
FIG. 45 is an illustrative top plan view of an exemplary center electrode 20 and a two-pronged ground electrode 450, which is similar to that shown in FIG. 3 but has shorter prongs which provide two tangential relationships 453, 454, as shown in the case 2 example in FIG. 44. An intermediate vertex 455 is also shown.

FIG. 45 is an illustrative top plan view of an exemplary center electrode 20 and a two-pronged ground electrode 450, which is similar to that shown in FIG. 3 but has shorter prongs which provide two tangential relationships 453, 454, as shown in the case 2 example in FIG. 44. An intermediate vertex 455 is also shown.

Figure 46:
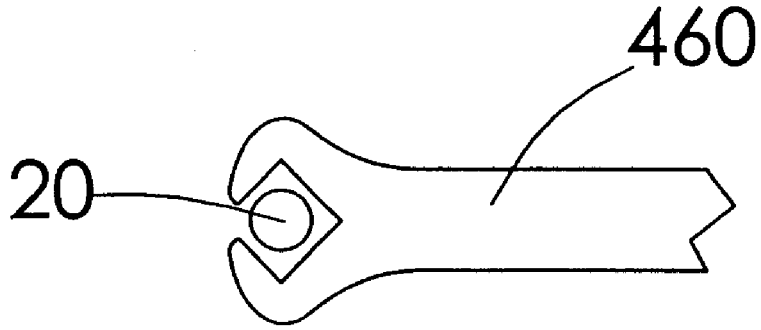
FIG. 46 is a "wide-box" configuration which is similar to that of FIG. 1, except that instead of having four tangential relationships, the four edges of the ground electrode 460 are outside the projection of the center electrode, and in the "zone" of FIG. 26. In the inventor's opinion at the time of filing, this provides additional room under the "intake charge flow" concept illustrated in FIG. 26.

FIG. 46 is a "wide-box" configuration which is similar to that of FIG. 1, except that instead of having four tangential relationships, the four edges of the ground electrode 460 are outside the projection of the center electrode, and in the "zone" of FIG. 26.

Figure 47:
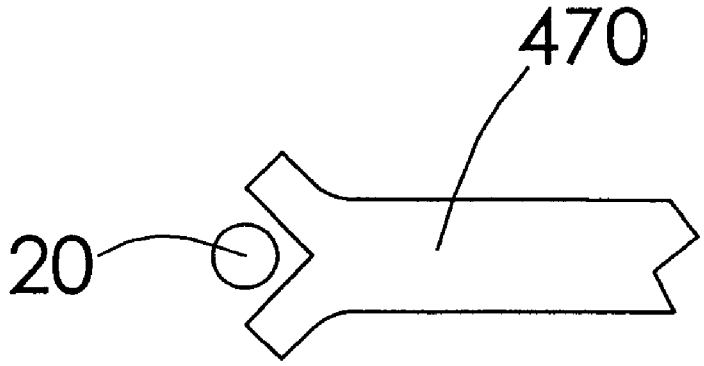
FIG. 47 is a "wide-fork" configuration which is similar to that of FIG. 3, except that instead of having two tangential relationships, the two edges of the ground electrode 470 are outside the projection of the exemplary center electrode 20, and in the "zone" of FIG. 26. In the inventor's opinion at the time of filing, this provides additional room under the "intake charge flow" concept illustrated in FIG. 26.
Figure 48A:
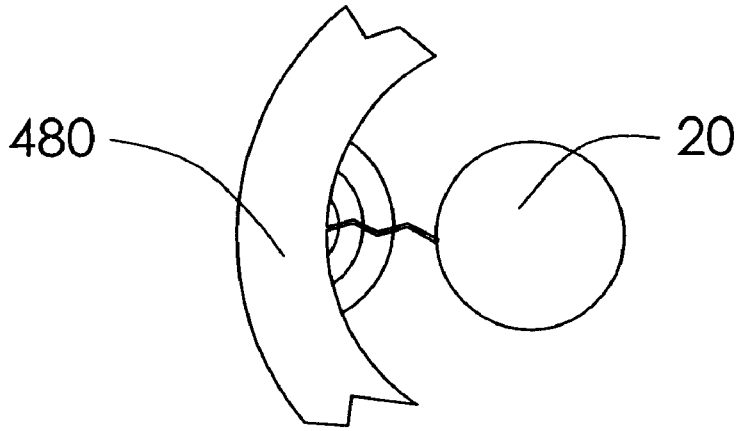
FIG. 48 illustrates a believed difference in concentric and nonconcentric electrode properties, showing a concentric ground electrode 480, an "open" ground electrode 481, each in association with a typical center electrode 20. As may be seen, open electrode surfaces are believed by the inventor to tend to encourage flame kernel propagation.
Figure 48B:
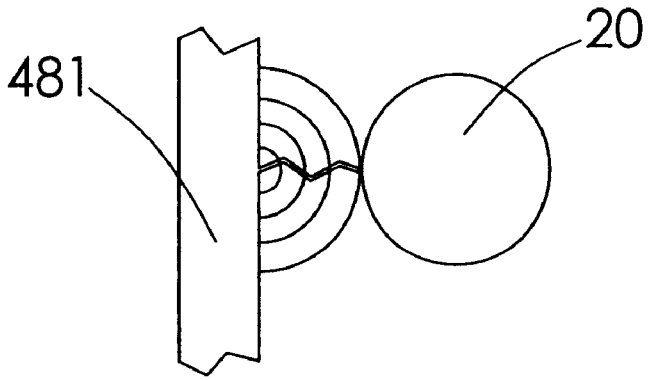

FIG. 47 is a "wide-fork" configuration which is similar to that of FIG. 3, except that instead of having two tangential relationships, the two edges of the ground electrode 470 are outside the projection of the exemplary center electrode 20, and in the "zone" of FIG. 26. In the inventor's opinion at the time of filing, this provides additional room under the "intake charge flow" concept illustrated in FIG. 26.

The Tangential Relationship

As noted above, in some instances it is desired to have a one or more straight edges in a tangential relationship with the circular (a.k.a "round" ) upper edge of the ground electrode. This will be referred to as a "straight edge tangential relationship" in that the straight edge defined by the ground electrode presents one or more straight edges such that each edge is in a tangential relationship to the center electrode's circumferential projection. Such is shown in, for example only, FIGS. 1, 3, 4, 9, and 10, although many others are shown).

However, it should also be understood that a "curved edge tangential relationship is also contemplated under one of the inventions disclosed herein, which is shown in, for example only, FIGS. 15, 23, and 25.

The important point to note is that the spark will connect between the center electrode and the closest ground. The actual placement of the ground electrode's prongs may be anywhere adjacent to or outside the peripheral (which need not necessarily be round) projection of the center electrode, at a chosen height at or above the center electrode's tip.

It should be understood that certain aspects of the invention contemplate the use of some offset of the tangential relationship, such as shown in FIGS. 17 and 26.

The Straightness of the Edges

As noted above, in some instances it is desired to have a straight edge in a tangential relationship with the curved upper edge of the ground electrode. However, it should be understood that certain aspects of the invention contemplate the use of curved edges in such a tangential relationship.

The Zone Concept

Reference is made to FIGS. 26 to illustrate the "Zone" concept, in which any of the positions shown expose the lower edge of the ground electrode to the center electrode's outer edge (a.k.a. its "upper peripheral edge", which could be circular).

This is another related concept of the invention, in which the edges that are presented or exposed to each other are not necessarily tangential, but they do present themselves to each other such that the edges are the closest parts of the two electrodes to each other, or are be at least as close as any other two parts of the electrodes, within the region of spark. It is believed that the "unshielding" of the top of the center electrode by placing the ground electrode outside the periphery is an advantageous concept above and separate from the tangential and/or vertex concepts. Again, it is believed that placing the lowest portion of the ground electrode's "active edge" at or above the center electrode allows the intake charge gases to flow more easily into the spark zone.

The Vertexes

It is believed at the time of filing that the combination of the tangential relationship and the vertexes, which is provided in some of the applicant's embodiments (for example those shown in FIGS. 1, 3, 4, 5, 6, and others) provides a distinct improvement over the prior art. Some of such vertexes provide a vertical "opening" or a "chimney effect" which is believed to provide improved flame characteristics. Furthermore, it is believed at the time of filing that the combination of the "zone" relationship and the vertexes, which is provided in some of the applicant's embodiments, provides a distinct improvement over the prior art Processes Used The simple shapes of the ground electrodes described in this application can be created by a secondary and subsequent operations on the standard wire-fed electrode currently in use in the industry. A mandrel of specific design can be used to form the various segments of each electrode. Alternately, a stamped electrode can be made using a die to create the specific configuration. The stamped electrode could then be welded to the spark plug base per usual practice. Instead of stamping, the electrode shape could be created by laser cutting, water jet cutting, chemical etching, forging, casting, powdered metal forming, etc. Any electrodes using these methods would then be welded to the spark plug base at the appropriate position.

With respect to the configurations shown in FIGS. 9 and 10, these electrode configurations can be created with little change to the current wire-feed arrangement. The offset with respect to the center electrode can be created in the basic wire feed machine set up, or by the use of a secondary operation that creates the specific alignment of the conventional sidewire.

Miscellaneous Comments

In, for example, FIG. 1, the thickness of the ground electrodes, including the end portions (including their segments), is as known in the art, or approximately 0.050", although the thickness can be 0.040–0.065", although it could be 0.010"–0.150", or other dimensions without departing from the spirit and scope of the present invention. The width of the "stem" can be 0.075–0.125", although it could be 0.010"–0.150", or other dimensions without departing from the spirit and scope of the present invention.

It is believed that the width of the prongs is not critical, but the sharpness of the edge(s). is important. However, in one preferred embodiment, the prongs are 0.050" wide and 0.050" thick, although each of these dimensions could be 0.010"–0.150", or other dimensions without departing from the spirit and scope of the present invention.

It should also be understood that it is not believed that the ground electrode be square or rectangular, as long as it includes a sharp corner which presents the lower corner edge to the center electrode as shown in FIGS. 14 or 26.

The center electrode diameter can be 0.010"–0.150". The thickness of the electrode. "stem", where applicable, can be 0.040–0.065", although it could be 0.010"–0.150", or other dimensions without departing from the spirit and scope of the present invention.

The materials used throughout are such as known in the art, including presently-used "premium" materials (e.g., platinum).

COMPARISON TO THE PRIOR ART

In contrast to the '651 patent, in the present invention, the striking surface for the spark on the ground electrode has been shaped in an open concave curve, a straight line, or even a convex curve in order to clear the way for the flame kernel to expand away from the sparking point. This occurs at a microscopic level such that any hint of a concentric radius on the striking surface has a negative effect on flame kernel growth. This discovery of the extreme sensitivity of the combustion process to this. striking surface radius is an important aspect of the present invention.

It is believed that concentric ring designs, no matter how minimal the length of the concentrically curved section, perform no better in practice than conventional spark plug designs. This is the substantial difference between the present invention and that described in the '651 patent. The latter always relies on a "hollow cylindrical ground electrode . . . by which combustion gas can gush out from . . . " (Column 2, line 59).

The ground electrode spacing in the '651 patent is always spaced away from the center electrode by a gap. In the present invention, tangential relationships are useful due to the open nature of the striking surface. Any concentric radius imparted to the striking surface in a tangential relationship would severely constrain the flame kernel generation.

Finally, the '651 patent incorporates two mounting stems which have a certain amount of shielding effect on the flame kernel, particularly when compared to the single stem of a preferred embodiment of the present invention.

CONCLUSION

While this invention has been described in specific detail with reference to the disclosed embodiments, it will be understood that many variations and modifications may be effected within the spirit and scope of the invention as described in the appended claims.

What is claimed is:

1. A spark plug for providing a spark within a sparking region, said spark plug when in an upright position comprising:

an upwardly-extending center electrode having a cross-sectional projection, a major dimension, and a height; and a ground electrode defining an elongate edge, said elongate edge extending further than the major dimension of the center electrode, said elongate edge being positioned substantially tangentially relative to said cross-sectional projection of said upwardly-extending center electrode, said elongate edge of said ground electrode having its lowest portion at or higher than the highest portion of said center electrode.

2. The spark plug of claim 1, wherein said edge is substantially straight.

3. The spark plug of claim 1, wherein said edge lies along a curved path having a radius greater than said center electrode and having a center of radius dissimilar than that of said center electrode.

4. A spark plug for providing a spark within a sparking region, said spark plug when in an upright position comprising:

an upwardly-extending center electrode having a major dimension and defining a center electrode edge; and a ground electrode defining at least one substantially straight elongate edge extending further than the major dimension of the center electrode, said at least one substantially straight elongate edge spaced apart from said center electrode edge, said at least one substantially straight elongate edge being positioned at or above a highest portion of said center electrode edge, said at least one substantially straight elongate edge also being positioned at or outside a peripheral projection of said center electrode edge, such that said center electrode edge and said at least one substantially straight elongate edge are presented towards each other such that said center electrode edge and said at least one substantially straight elongate edge are closest portions of the center electrode and the ground electrode within the sparking region.

5. A spark plug for providing a spark within a sparking region, said spark plug when in an upright position comprising:

an upwardly-extending center electrode defining a center electrode edge, a ground electrode defining at least one elongate edge, said at least one elongate edge spaced apart from said center electrode edge, said at least one elongate edge being positioned only at or above a highest portion of said center electrode edge, said at least one elongate edge also being positioned only at or outside a peripheral projection of said center electrode edge, said elongate edge having portions being non-concentric with said center electrode edge, such that said center electrode edge and said at least one elongate edge are presented towards each other such that the edges are closest portions of the center electrode and the ground electrode within the sparking region.

6. A spark plug for providing a spark within a sparking region, said spark plug when in an upright position comprising:

an upwardly-extending center electrode having a cross-sectional projection, a major dimension and a height; and a ground electrode defining at least one elongate edge being non-concentric with the center electrode and extending further than the major dimension of the center electrode, said at least one elongate edge being outside the projection, and a lowest portion of the ground electrode being at or higher than the highest portion of said center electrode;

such that said center electrode edge and said at least one elongate edge are presented towards each other such that said center electrode edge and said at least one elongate edge are closest portions of the center electrode and the ground electrode within the sparking region.

7. The spark plug of claim 6, wherein said upwardly-extending center electrode having a substantially circular transverse cross-section having a diameter.

8. A spark plug for providing a spark within a sparing region, said spark plug when in an upright position comprising:

an upwardly-extending center electrode having a cross-sectional projection; and a ground electrode defining two elongate edges each in a substantially tangential relationship relative to said cross-sectional projection of said upwardly-extending center electrode, said edges also combining to form one intermediate vertex outside said projection.

9. A spark plug for providing a spark within a sparking region, said spark plug when in an upright position comprising:

an upwardly-extending center electrode having a cross-sectional projection; and a substantially box-shaped ground electrode with a split at the end, said split creates two ends with each end turned back, providing four tangential relationships relative to the cross-sectional projection and also providing three intermediate vertexes.

10. A spark plug for providing a spark within a sparking region, said spark plug when in an upright position comprising:

an upwardly-extending center electrode defining at least one substantially straight and non-circular elongate edge; and a ground electrode defining an edge, said center electrode edge and said ground electrode edge being in a non-concentric relationship and are closest portions of the center electrode and the ground electrode to allow for sparking therebetween.

11. A spark plug for providing a spark within a sparking region, said spark plug when in an upright position comprising:

a center electrode having a circular outline; and a ground electrode including a main portion extending above the center electrode and diverging into two prongs, said prongs forming a partial box shape, said box shape including four sections oriented substantially tangential to said circular outline of said center electrode.

12. The spark plug as claimed in claim 11, wherein said ground electrode includes a vertex portion located outside of the circular outline of said center electrode.

13. The spark plug as claimed in claim 12, such that at least two segments of the two prongs lie substantially along said circular outline of said center electrode.

14. The spark plug as claimed in claim 13, such that first and third portions are substantially parallel.

15. The spark plug as claimed in claim 14, such that said second and fourth sections are substantially parallel.

16. A spark plug for providing a spark within a sparking region, said spark plug when in an upright position comprising:

a center electrode; and a ground electrode extending above the center electrode, said ground electrode defining at least three tangential relationships.

17. The spark plug as claimed in claim 16, wherein said ground electrode defining at least four tangential relationships.

18. The spark plug as claimed in claim 16, wherein said ground electrode defining at least five tangential relationships.

19. A spark plug for providing a spark within a sparking region, comprising:

an upwardly-extending center electrode comprising an outside edge; and a ground electrode comprising a first edge and a second edge coupled together at a vertex;

wherein the first edge, the second edge, and the vertex of the ground electrode are positioned at or outside a peripheral projection of said center electrode edge such that the first edge or the second edge of the ground electrode is the closest portion of the ground electrode to the center electrode and the outside edge of the center electrode is the closest portion of the center electrode to the ground electrode to allow for sparking to occur between the ground electrode and the center electrode.

20. A spark plug for providing a spark within a sparking region, said spark plug when in an upright position comprising:

an upwardly-extending center electrode defining a center electrode edge, a ground electrode defining at least one substantially straight elongate edge, said at least one substantially straight elongate edge spaced apart from said center electrode edge, said at least one substantially straight elongate edge being positioned only at or above a highest portion of said center electrode edge, said at least one substantially straight elongate edge also being positioned only at or outside the peripheral projection of said center electrode edge, such that said center electrode edge and said at least one substantially straight elongate edge are presented towards each other such that the edges are the closest portions of the center electrode and the ground electrode within the sparking region.

* * * * *